US006077179A

United States Patent [19]

Liechty, II

[11] Patent Number: 6,077,179

[45] Date of Patent: Jun. 20, 2000

[54] ARROWHEAD WITH A TIP HAVING CONVEX FACETS

[76] Inventor: Victor Jay Liechty, II, 1250 N. 1750 W., Provo, Utah 84604

[21] Appl. No.: 09/303,760

[22] Filed: May 3, 1999

Related U.S. Application Data

[63] Continuation of application No. 09/082,636, May 21, 1998.

[51] Int. Cl.[7] ..... F42B 6/08

[52] U.S. Cl. ..... 473/582; 473/583

[58] Field of Search ..... 473/578, 582, 473/583, 584, FOR 216, FOR 219, FOR 221, FOR 222

[56] References Cited

U.S. PATENT DOCUMENTS

| | | | |
|---|---|---|---|
| 2,568,417 | 9/1951 | Steinbacher . | |
| 3,000,635 | 9/1961 | Nieman . | |
| 3,036,395 | 5/1962 | Nelson . | |
| 3,759,519 | 9/1973 | Palma . | |
| 4,166,619 | 9/1979 | Bergmann et al. . | |
| 4,210,330 | 7/1980 | Kosbab . | |
| 4,381,866 | 5/1983 | Simo . | |
| 4,452,460 | 6/1984 | Adams . | |
| 4,529,208 | 7/1985 | Simo . | |
| 4,558,868 | 12/1985 | Musacchia . | |
| 4,565,377 | 1/1986 | Troncoso . | |
| 4,576,589 | 3/1986 | Kraus et al. . | |
| 4,601,710 | 7/1986 | Moll . | |
| 4,615,529 | 10/1986 | Vocal . | |
| 4,616,835 | 10/1986 | Trotter . | |
| 4,621,817 | 11/1986 | Musacchia | 473/578 X |
| 4,643,435 | 2/1987 | Musacchia . | |
| 4,676,512 | 6/1987 | Simo . | |
| 4,742,637 | 5/1988 | Musacchia . | |
| 4,932,671 | 6/1990 | Anderson, Jr. . | |
| 4,940,246 | 7/1990 | Stagg . | |
| 4,973,060 | 11/1990 | Herzing . | |
| 5,044,640 | 9/1991 | Del Monte et al. . | |
| 5,046,744 | 9/1991 | Eddy . | |
| 5,057,082 | 10/1991 | Burchette, Jr. . | |
| 5,064,202 | 11/1991 | Barner | 473/583 |
| 5,078,407 | 1/1992 | Carlston et al. . | |
| 5,082,292 | 1/1992 | Puckett et al. . | |
| 5,090,709 | 2/1992 | Johnson . | |
| 5,100,143 | 3/1992 | Puckett . | |
| 5,102,147 | 4/1992 | Szeluga . | |
| 5,112,063 | 5/1992 | Puckett . | |
| 5,119,797 | 6/1992 | Anderson | 473/578 X |
| 5,137,282 | 8/1992 | Segar et al. . | |
| 5,160,148 | 11/1992 | Musacchia, Sr. . | |
| 5,172,916 | 12/1992 | Puckett . | |
| 5,178,398 | 1/1993 | Eddy . | |
| 5,178,399 | 1/1993 | Garoutte . | |
| 5,286,035 | 2/1994 | Ward . | |
| 5,342,382 | 8/1994 | Brinkerhoff et al. . | |
| 5,385,572 | 1/1995 | Nobles et al. . | |
| 5,458,341 | 10/1995 | Forrest et al. . | |
| 5,478,089 | 12/1995 | Austin | 473/582 |
| 5,482,293 | 1/1996 | Lekavich . | |

(List continued on next page.)

OTHER PUBLICATIONS

Wasp Diamond—Point Chisel Tip—Wasp Archery Products Bowhunter Aug./Sep. 1990 p. 48.

Rocky Mot Gator—Barrie Archery—as per ABCC Ad Book 4th Edition Apr. 1995 pp. 2–10.

Dragon Tail—Bangtail MFG—as per ABCC Ad Book 4th Edition Apr. 1995 p. Misc 1b.

Mohawk Broadhead—Mohawk Archery Products as per ABCC Ad Book 4th Edition Apr. 1995, p. M–8.

Ben Pearson Fishing Point—as per ABCC Ad Book 4th Edition Apr. 1995 p. B–22.

Little Shaver Braodhead—as per ABCC Ad Book 4th Edition Apr. 1995 p. L–2.

The Fang—Arrow Enterprise Inc. as per ABCC Ad Book 4th Edition Apr. 1995, p. F–2.

*Primary Examiner*—John A. Ricci

[57] ABSTRACT

Arrowheads having multi-facted forward tip ends with convex shaped facets thereon.

55 Claims, 23 Drawing Sheets

U.S. PATENT DOCUMENTS 5,482,294 1/1996 Sullivan et al. .
5,496,042 3/1996 Craft et al. .
5,496,043 3/1996 Ester .
5,564,713 10/1996 Mizek et al. .
5,624,459 4/1997 Kortenbach et al. ..... 606/185
5,803,844 9/1998 Anderson ..... 473/583
5,803,845 9/1998 Anderson ..... 473/583
5,820,498 10/1998 Maleski ..... 473/584
5,857,930 1/1999 Troncoso ..... 473/583
5,871,410 2/1999 Simo et al. ..... 473/583
5,879,252 3/1999 Johnson ..... 473/583

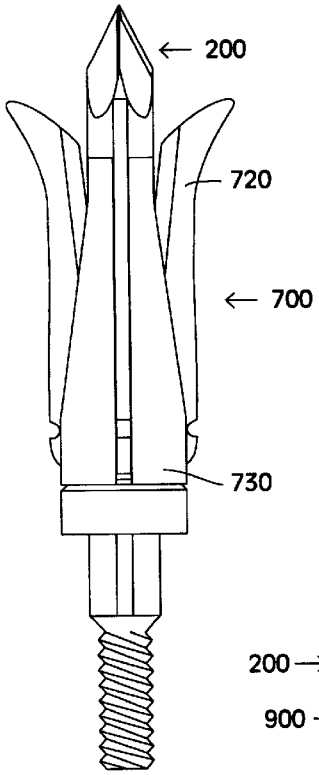
FIG. 7
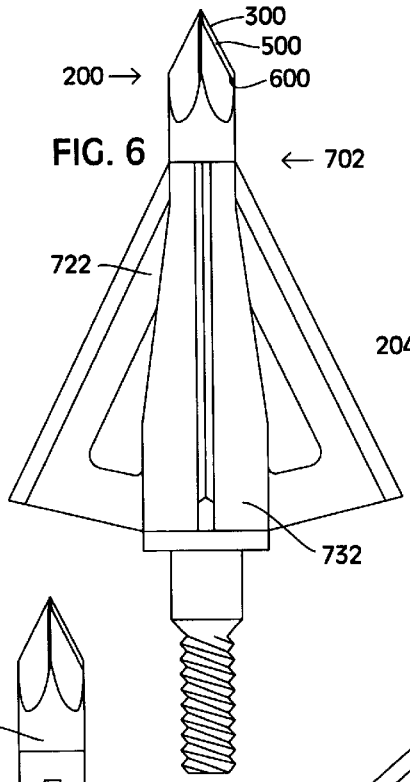
FIG. 6
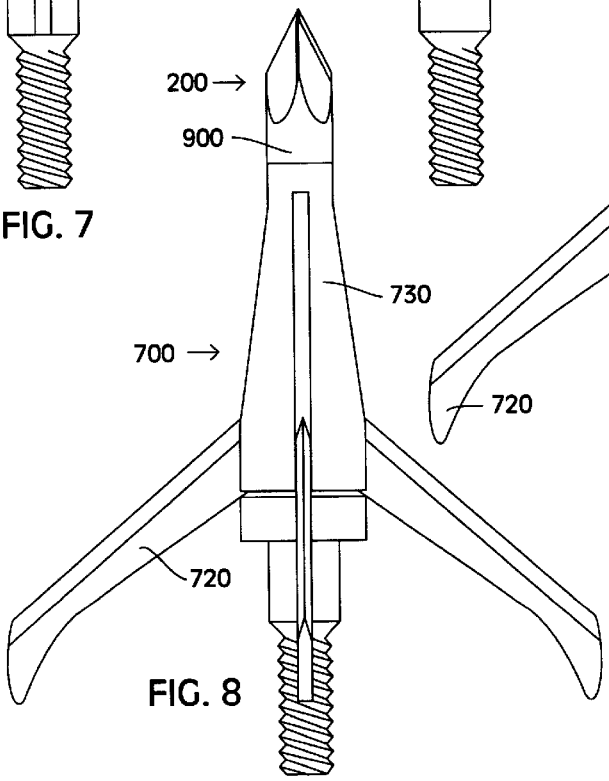
FIG. 8
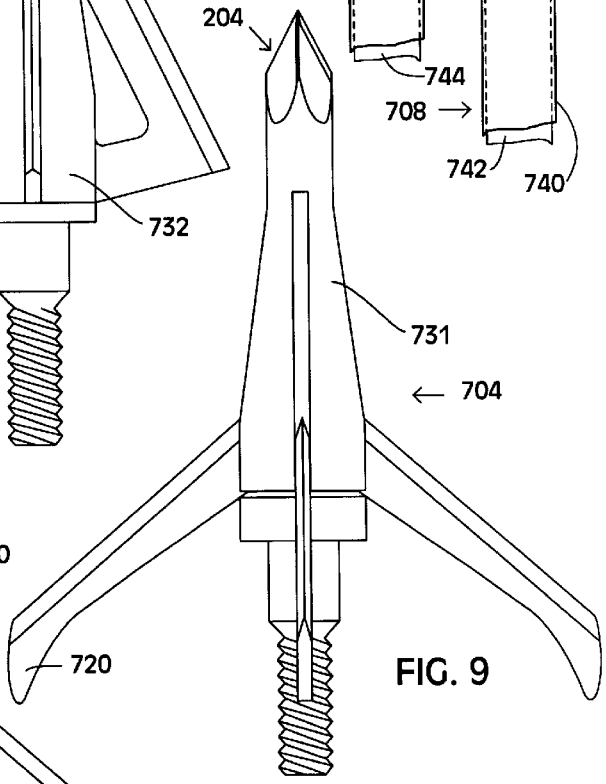
FIG. 9
FIG. 10
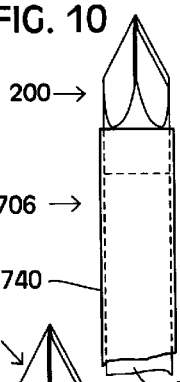
FIG. 11
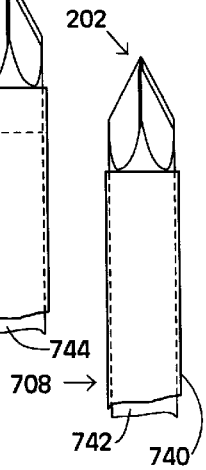

r
804
837
802
836
800

Y
1010
200
400
X
900
Z 200
1010
X
400
1008
660
Z
822
r
842
820

1008
Y
X
Z 818
200
660

300
X
500
600
400
r
806
810
Z
1012
Y
808
1010
838
r
810
806
300
500
200
600
400

X
900
Z
r
816
840
814
812

404
208 →
404
604
504
304

208 →
404
604
504
304

210 →
406
606
506
306

210 →
406
606
506
306

← 212
408
608
508
308

← 212
408
608
508
308

410
214 →
610
510
310

214
410
610
510
310

412
← 216 →
612
512
312

412
612
512
312

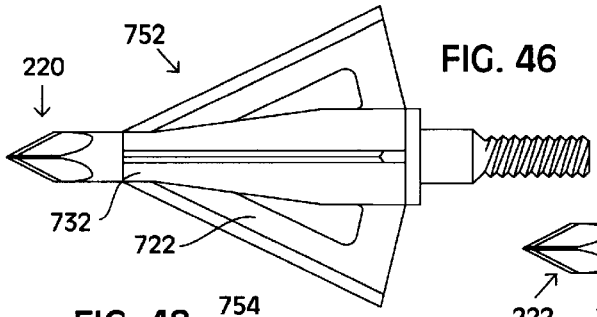
FIG. 46
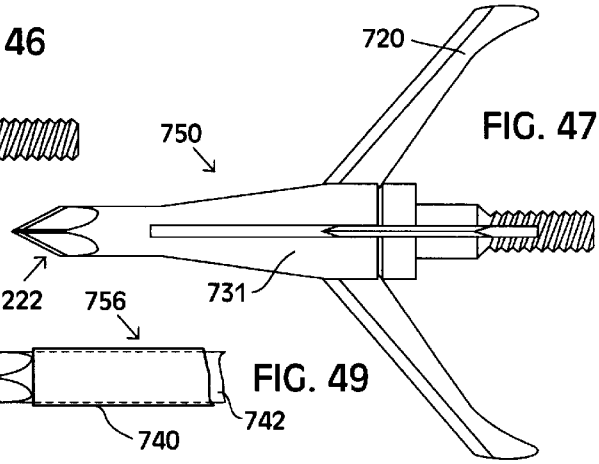
FIG. 47
FIG. 48
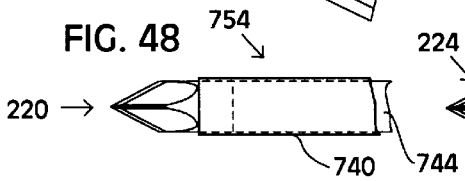
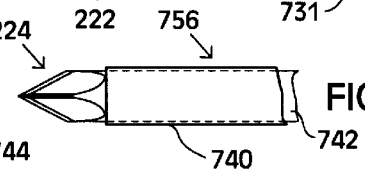
FIG. 49
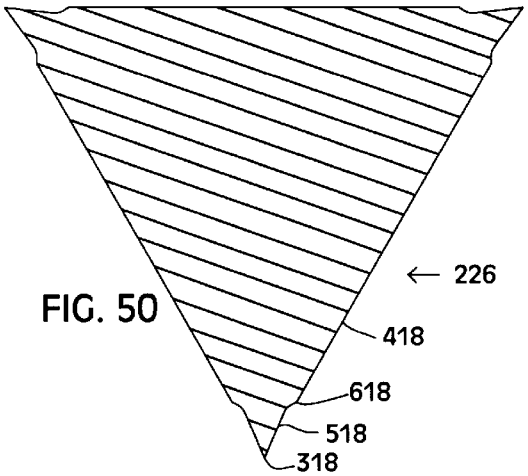
FIG. 50
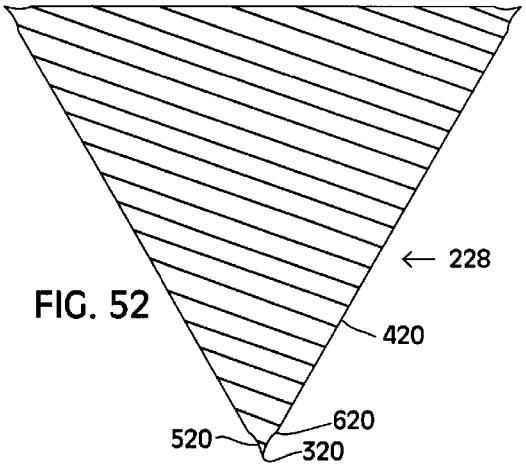
FIG. 52
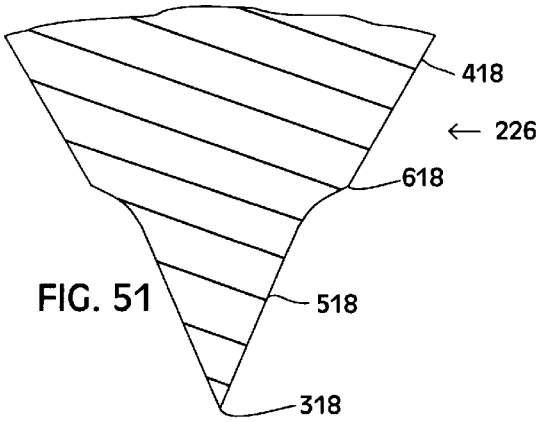
FIG. 51
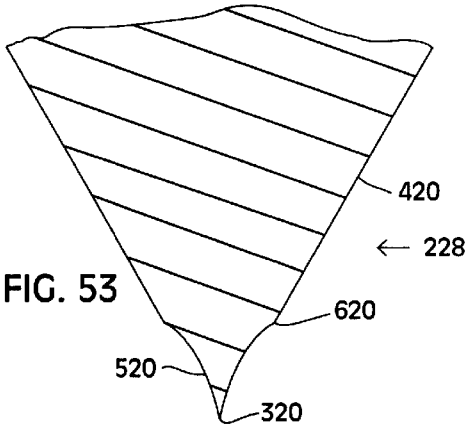
FIG. 53

232
424
522
522
524
524
324

422
230

622
526
528
322
322
528
55
55
422
526
230
622

692
690
1036
422
230
622
1034
1032
526

528
322
424
232

624
624
522
522
524
524
324
426

626
234
530
532
326
426
236
626

530
534
328

536
330
630
238
430
240
538
332
632
432

660
330
536
630
238
430

536
330
64
64
630
430
238

330
536
630
238
686
688
660
660
430
684
1020
682
1030
1022
630
536
330
660

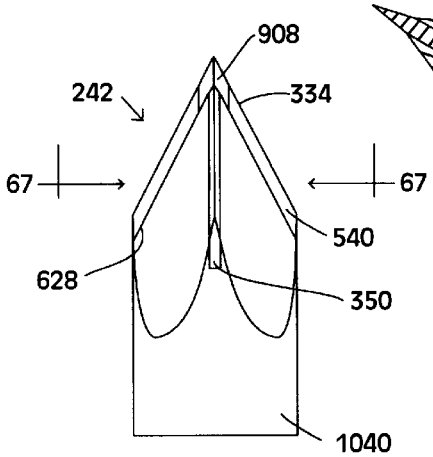
FIG.66
FIG. 67
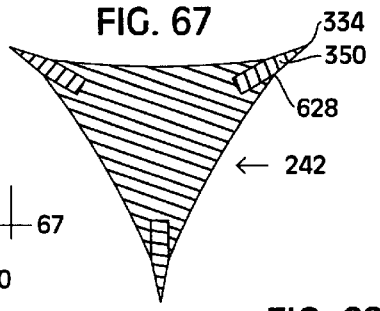
FIG. 68
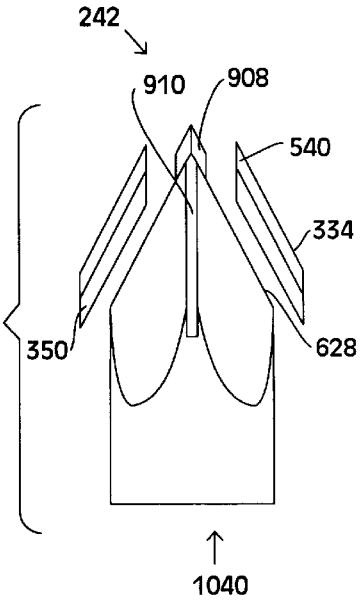
FIG. 70
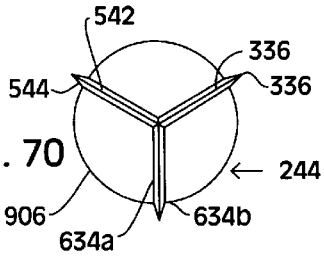
FIG. 71
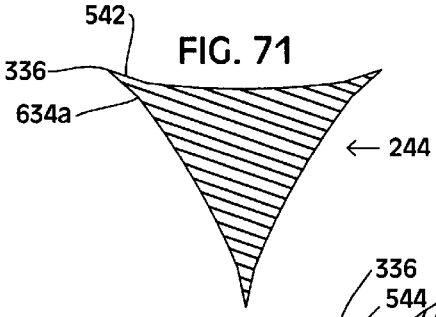
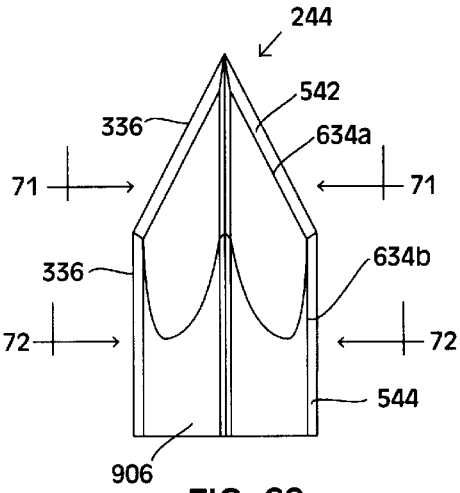
FIG. 69
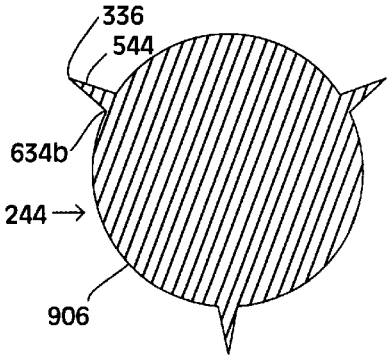
FIG. 72

FIG. 78
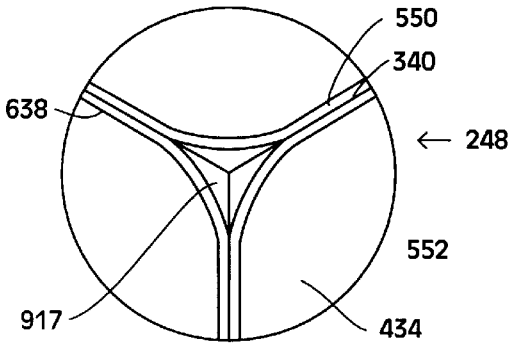
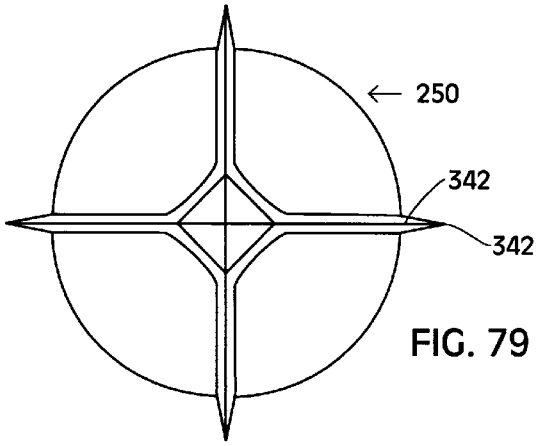
FIG. 79
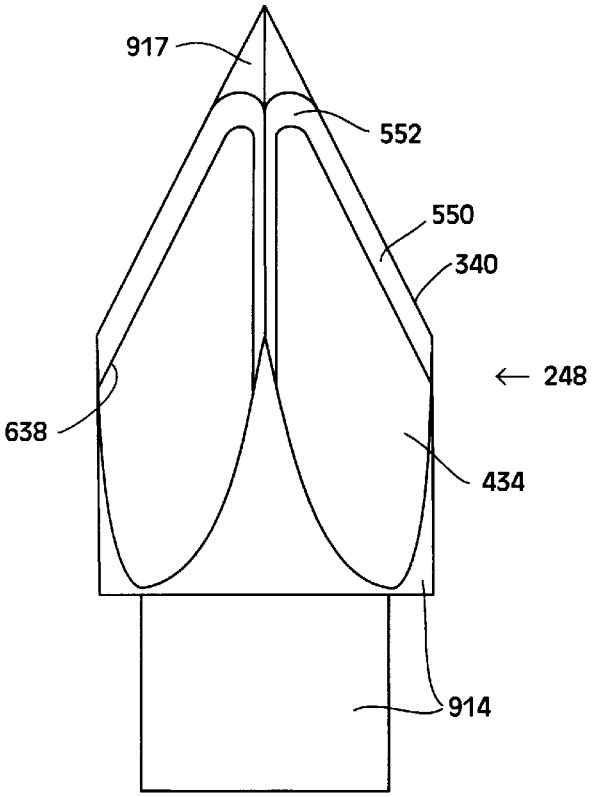
FIG. 77
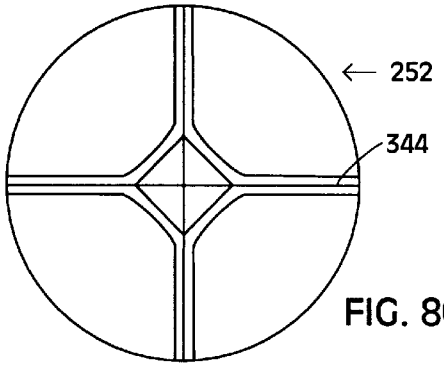
FIG. 80
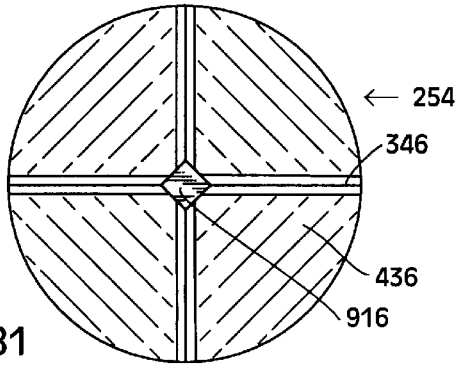
FIG. 81

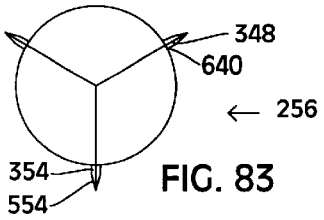
FIG. 83
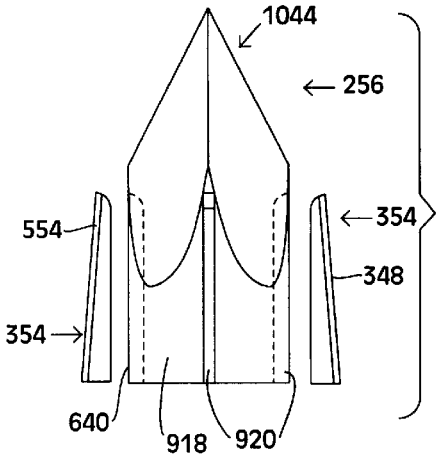
FIG. 84
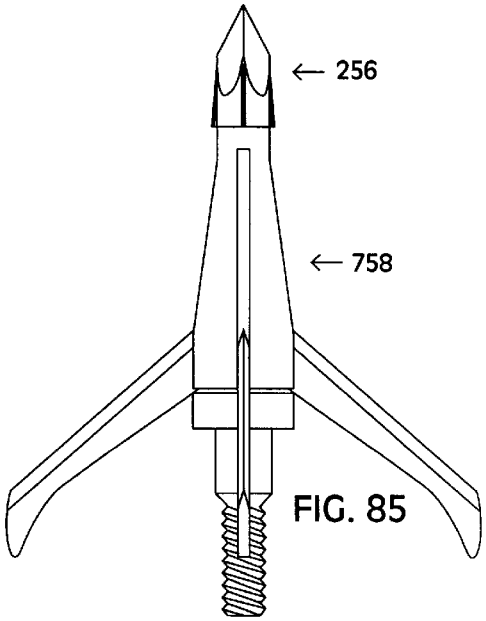
FIG. 85
FIG. 87
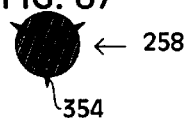
FIG. 88
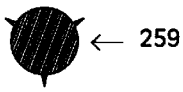
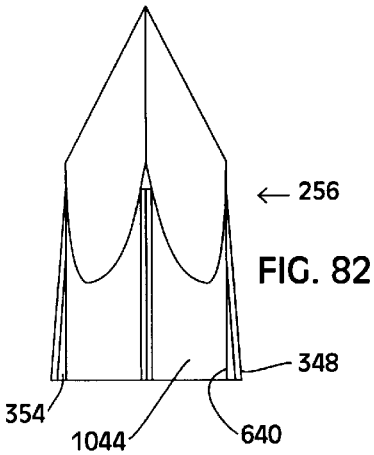
FIG. 82
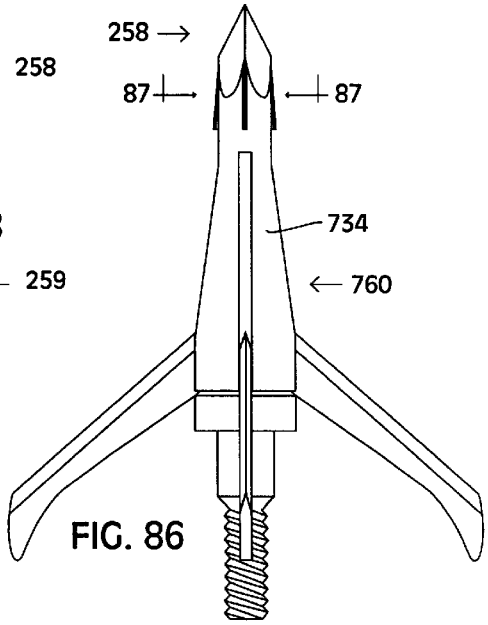
FIG. 86

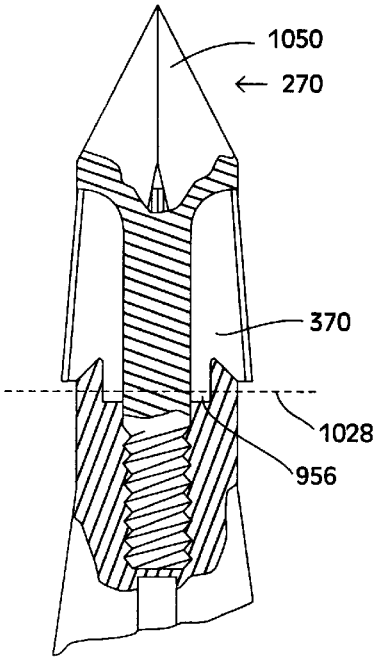
FIG. 101
FIG. 100
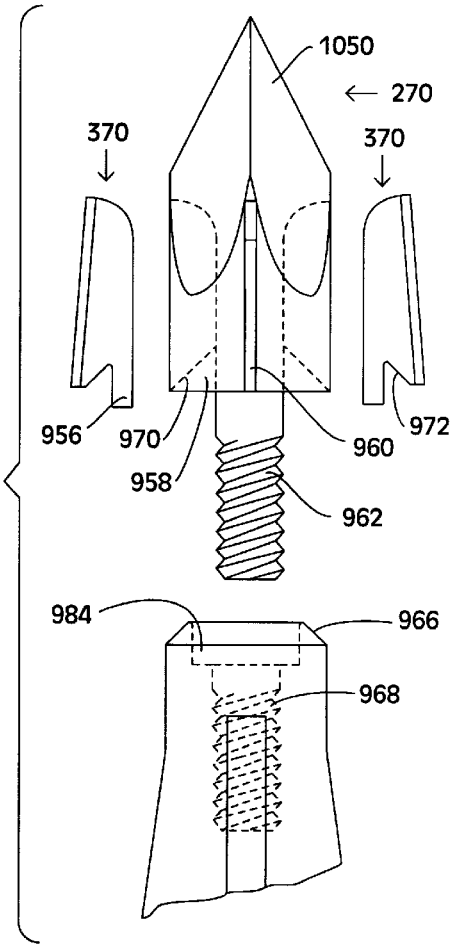
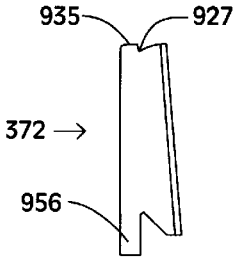
FIG. 102

772
726
270

372
271

271
1051
929
935
937
927
372
970
966
956
972
962
984
968
774

271

935
927
937
929
1028
372
774
972
1028
956

376
272
728

376
976

1052
272
376
982
976
728

274
978
378
980
778
780
330
276
113
113
978
330

276
378

FIG. 114
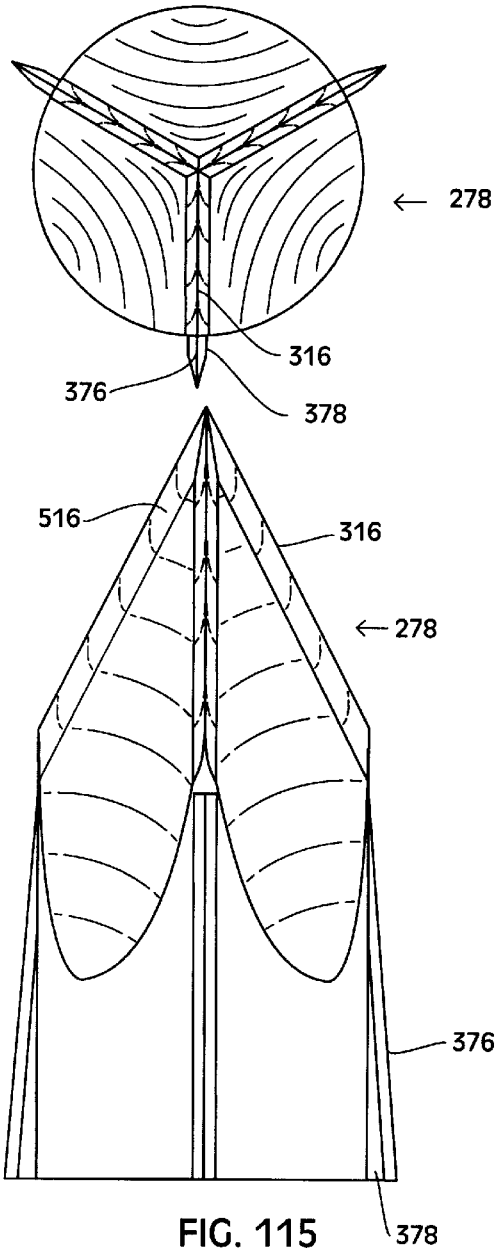
FIG. 115
FIG. 116
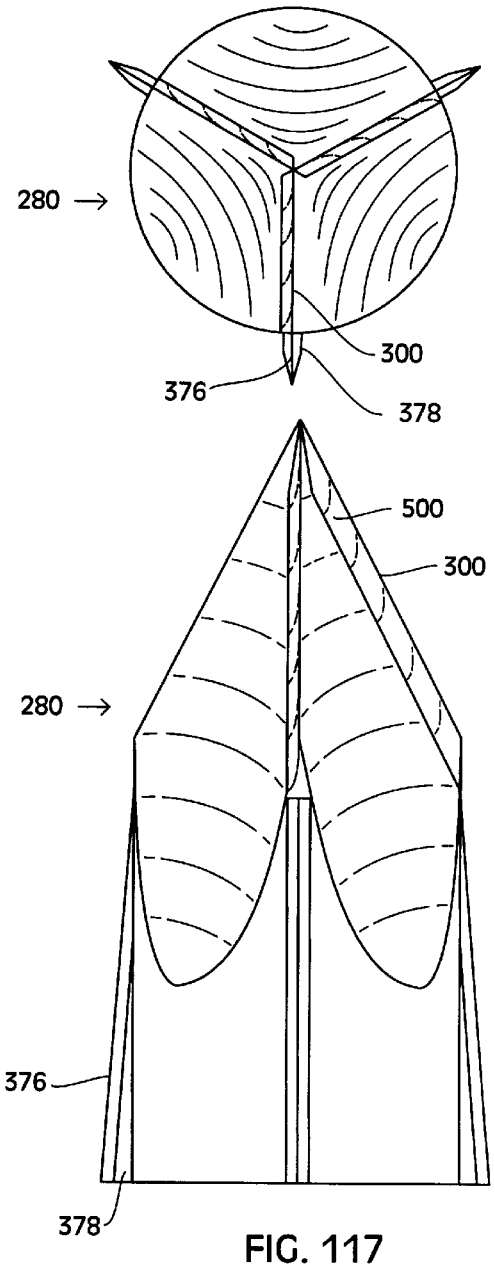
FIG. 117

ARROWHEAD WITH A TIP HAVING CONVEX FACETS

This application is a continuation application of my U.S. patent application Ser. No. 09/082,636 filed May 21, 1998.

BACKGROUND—DESCRIPTION OF PRIOR ART

Devices having a leading penetrating end used to penetrate a substance are used in many types of applications, including use in archery equipment and surgical instruments. A popular type of penetrating end point or tip that is used both in archery and surgery is the trocar tip. The word trocar has Latin roots of tres meaning three and carre meaning side of a sword or knife. A trocar tip is therefore three sided and is the pointed leading end of an object used to cut or pierce. The three sides of trocar tips are generally hollow ground. The term hollow ground refers to the grinding process used to fabricate the sides of the tip and generally means that the sides are dished-out or substantially concave, as compared to being flat. The hollow ground feature gives the tip better defined cutting edges at the juncture of the sides with each other than the cutting edges at side junctures of tips having flat sides. The hollow ground feature also gives the tip the ability to easily push the substance being penetrated away from the tip. The earliest known use of trocar tips date back to the medieval times where they were used on the leading ends of knights' lances.

In surgery a surgical trocar is one type of a surgical instrument that has a leading penetrating end. Surgical trocars are generally used to pierce body cavities during the surgical procedures of dropsy, endoscopy and laparoscopy etc. The penetrating ends of surgical trocars generally have a type of trocar tip, since from such tip they were named. There are various types of surgical trocars, with a variety of different options and accessories available depending on the procedure(s) to be performed. However, the leading end point of the surgical trocar should be as sharp as possible, should push penetrated or cut tissue away from its cutting path, and also should be as cost effective to produce as possible.

In archery a bow is used to shoot an arrow towards a target. A conventional arrow has a shaft, a nock at one end that receives the bow string, and an arrowhead or point that attaches to the opposite end of the arrow shaft which aids in penetrating the target. Arrowheads generally have a pointed forward end, and an opposite threaded shaft end that attaches the arrowhead to the arrow shaft. Arrowheads come in a variety of different sizes and configurations depending on their intended use. For example, there are specifically designed arrowheads for competitive target shooting, shooting fish, hunting birds or small game animals, and for hunting big game animals.

Arrowheads used for bowhunting are generally know as broadheads. Broadheads have cutting blades and kill game animals by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal. The two most common types of arrowheads used for hunting are fixed-blade arrowheads and blade-opening arrowheads or mechanical arrowheads. Blade-opening arrowheads differ from conventional fixed-blade arrowheads in that the cutting blades are folded up or held adjacent to the arrowhead body in a retracted position while the arrow is in flight, but at impact with the game animal rotate or pivot into an open position, whereas the blades of fixed-blade arrowheads are permanently held at a full cutting diameter position at all times.

Both blade-opening and fixed-blade arrowheads have a pointed tip end used for penetrating the game animal. The tip of the arrowhead may be separably attachable to the arrowhead body or may be integral with it. Conventional arrowheads have historically had two basic types of pointed arrowhead tips: bone-crushing chisel type tips such as the hollow ground trocar tip, and razor blade type tips. The razor blade tips are generally just an extension of the cutting blades of the arrowhead and terminate in a leading pointed apex. Both types of arrowhead tips are designed to maximize penetration and therefore provide a more lethal arrowhead by cutting a larger volume of animal tissue. Despite their designs and intent both the bone crushing chisel tips and the razor blade tips fall short of providing optimum penetrating performance. Since the arrowhead razor blade type tips generally have a true cutting edge, or a cutting edge that has a small enough angle between opposing sides so as to make it as sharp as a razor or scalpel blade, they penetrate the best through soft tissues such as skin, muscles, lungs and other internal organs by slicing or cutting. But when a razor blade tip impacts bone the thin cutting blade generally gets sheared or broken-off due to the heavy impact forces delivered to it, and thus leaves a blunt snagging leading end that greatly inhibits penetration and therefore is less lethal in many instances—since arrowheads very commonly impact bone when penetrating game animals. The bone-crushing chisel tips on the other hand split right through heavy bone but lack a truly sharp cutting edge and therefore do not perform as well in penetrating the skin and other soft tissues.

Attempts in the prior art have been made to combine a scalpel sharp cutting edge with bone splitting capabilities into an optimally penetrating arrowhead tip, but these attempts have their own problems as well. For example the introduction of chisel tips with hollow ground sides, such as the three sided trocar tip for arrowhead points helped reduce the angle of the cutting edge between the sides of the tip. But the edges of conventional trocar arrowhead tips and other hollow ground arrowhead tips are still relatively dull and are a far cry from having the fine cutting angle or edge a scalpel or razor blade possesses. Other attempts in the prior art to increase the sharpness of the edges of chisel type arrowhead tips have been made by increasing the curvature of the hollow ground sides. This practice greatly weakens the tip giving it problems similar to those of the razor blade type tips and also provides a tip that does not push the tissue away from the arrowhead optimally.

It is apparent that there are needed improvements in cutting tips.

It is apparent that there is a need for an arrowhead cutting tip that combines the optimal penetration features of the most rugged bone splitting trocar or chisel type arrowhead tips with the razor sharp cutting features of the razor blade type arrowhead tips into one arrowhead tip.

It is also apparent that there is a need for a cutting tip of a surgical trocar that is cost effective to produce, extremely sharp, and that pushes the penetrated or cut tissue away from its cutting path.

SUMMARY OF THE INVENTION

It is one object of the present invention to provide cutting tips and penetrating tips that cut and/or penetrate more efficiently than prior art cutting tips.

It is another object of the present invention to provide a cutting tip that has a smaller angle as referenced between cutting tip structure such as adjoining sides or facets that are located a distance closer to their respective cutting edge than an angle as referenced between cutting tip structure such as adjoining sides or facets located a distance further from the respective cutting edge than the first or closer distance, as measured in the same perpendicular plane to the central longitudinal axis of the respective cutting tip.

It is another object of the present invention to provide a cutting tip that has a side or facet with a cutting edge from which for at least a portion of the time that the cutting edge of the facet is being formed, facet material is removed from only the bisected side of the facet that the cutting edge being formed is on.

It is another object of the present invention to provide a cutting tip that has a side or facet that is formed at least in part from a rotational grinding wheel whose axis of rotation is inclined with respect to the central longitudinal axis of the cutting tip when forming at least a portion of the facet.

It is another object of the present invention to provide a cutting tip that has a side or facet with a facet bisecting plane, wherein the facet is formed at least in part from a rotational grinding wheel whose axis of rotation is inclined with respect to the bisecting plane of the facet when forming at least a portion of the facet.

It is another object of the present invention to provide a cutting tip having a central longitudinal axis that is collinear with the Y-axis of a Cartesian X-Y-Z axis system, and a side or facet that is formed from a plurality of rotational machining tools -such as grinding wheels- each having an axis of rotation where the axis of rotation of at least one rotational machining tool of the plurality of rotational machining tools is oriented, with respect to at least one of the X-Y-Z axises and therefore at least one of the corresponding three dimensional planes X-Y, X-Z and Y-Z when forming its particular portion of the facet or cutting tip, in a different manner or spatial orientation than the spatial orientation the axis of rotation of at least one other rotational machining tool of the plurality of rotational machining tools when the other rotational machining tool is forming its particular portion of the facet or cutting tip.

It is another object of the present invention to provide a cutting tip that has a side or facet that is formed from a plurality of rotational machining tools each having a radius of rotation where at least one rotational machining tool of the plurality of rotational machining tools has a radius of rotation that has a different length of radius than the radius of rotation of at least one other rotational machining tool.

It is another object of the present invention to provide a cutting tip that has a side or facet that is formed from a plurality of rotational machining tools each having an axial thickness where at least one rotational machining tool of the plurality of rotational machining tools has a different axial thickness than the axial thickness of at least one other rotational machining tool.

It is another object of the present invention to provide a cutting tip that has a side or facet that is formed from a plurality of rotational machining tools each having an exterior circumferential profile where at least one rotational machining tool of the plurality of rotational machining tools has a different exterior circumferential profile than the exterior circumferential profile of at least one other rotational machining tool.

It is also another object of the present invention to provide a cutting tip whose barrel portion has a razor sharp cutting edge.

It is also another object of the present invention to provide a cutting tip which has tip blades.

It is also another object of the present invention to provide a blade-opening arrowhead having blades that pivot in a rearward direction away from the tip of the arrowhead, which has a razor sharp cutting tip to enhance penetration.

It is still another object of the present invention to provide a faceted cutting tip of a surgical trocar that is cost effective to produce, extremely sharp, and that pushes the penetrated or cut tissue away from its cutting path.

It is yet further another object of the present invention to provide an arrowhead cutting tip that combines the optimal penetration features of the most rugged bone splitting trocar or chisel type arrowhead tips with the razor sharp cutting features of the razor blade type arrowhead tips into one arrowhead tip.

The foregoing objects and advantages and other objects and advantages of the present invention are accomplished as according to one preferred embodiment of this invention with a three faceted hollow ground stainless steel cutting tip that has a bevel ground on each facet adjacent to and communicating with each cutting edge which is located at each facet juncture with an adjacent facet, such that the angle between the bevel of one facet and the facet on the side of the cutting edge opposite the facet with the bevel thereon is less than an angle measured between points located a distance from the cutting edge that is beyond the bevel or further from the cutting edge than the bevel. Such a cutting tip is preferably formed by first grinding the three hollow ground facets with a specific grinding wheel, and then by grinding each of the three bevels on the hollow ground facets with a different grinding wheel. Such a cutting tip enables the formation of an extremely sharp cutting edge at each facet juncture, such as that is attainable on a scalpel blade or a razor blade, while retaining the facet structure necessary to optimally push penetrated material away from the cutting tip and to easily split and crush heavy bone. Such a cutting tip would in effect combine the optimal penetration features of the most rugged bone splitting trocar or chisel type arrowhead tips with the razor sharp cutting features of the razor blade type arrowhead tips into one arrowhead tip, and thus create a deep penetrating and ultimately tough and lethal trocarazor or trocrazor arrowhead tip.

Another preferred embodiment according to this invention differs from the above described embodiment in that there are two bevels formed upon each facet so that each cutting edge has a bevel on either side of it.

Other preferred embodiments according to this invention have razor sharp cutting edges located on the barrel portion of each cutting tip, or the portion of the cutting tip reward of the facets. According to some such embodiments the cutting tips may have both razor sharp edges located upon the barrel section of the tips and also at the facet junctures.

Yet other preferred embodiments according to this invention differ from the above described embodiments in that the razor sharp edges are attained by attachment of separate razor blades or tip blades to the cutting tips by inserting them into slots in the cutting tip body. According to some such preferred embodiments the tip blades are integrally attached to the tip body, such as by welding. According to other such preferred embodiments the attachable tip blades are removably attachable.

Yet still other preferred embodiments according to the cutting tips of this invention differ from the above described embodiments in that the facets are flat or convex, or that the cutting tips have differing numbers of facets or differing shapes, may be made of different materials, may have friction reducing elements applied thereto such as polytetrafloroethylene (PTFE), and may have different numbers of cutting edges associated therewith.

The cutting tips according to this invention overcome deficiencies inherit in prior art cutting tips. The cutting tips according to this invention have sharper edges while retaining optimal strength and optimal material pushing capabilities. The cutting tips as according to this invention provide for a more lethal arrowhead tip that is capable of deeper penetration than prior art arrowhead tips. The cutting tips according to this invention are also simple and feasible to manufacture.

With the above objects and advantages in view, other objects and advantages of the invention will more readily appear as the nature of the invention is better understood, the invention is comprised in the novel construction, combination and assembly of parts hereinafter more fully described, illustrated, and claimed.

BRIEF DESCRIPTION OF THE DRAWINGS

FIG. 6 is a side view of a fixed-blade arrowhead with a cutting tip according to a preferred embodiment of this invention;

FIG. 7 is a side view of a blade-opening arrowhead with a cutting tip according to a preferred embodiment of this invention, showing the pivotal blades in the closed position;

FIG. 8 is a side view of the blade-opening arrowhead as illustrated in FIG. 7 showing the pivotal blades in the open position;

FIG. 9 is a side view of a blade-opening arrowhead similar to the blade-opening arrowhead as illustrated in FIGS. 7 & 8 except the cutting tip is integral with the arrowhead body.

FIG. 10 is a side view of a surgical trocar with a removably attachable cutting tip as according to a preferred embodiment of this invention;

FIG. 11 is a side view of another surgical trocar with an integral cutting tip as according to a preferred embodiment of this invention;

FIG. 46 is a side view of a fixed-blade arrowhead with a cutting tip according to a preferred embodiment of this invention;

FIG. 47 is a side view of a blade-opening arrowhead with an integral cutting tip according to a preferred embodiment of this invention, showing the pivotal blades in the open position;

FIG. 48 is a side view of a surgical trocar with a removably attachable cutting tip as according to a preferred embodiment of this invention;

FIG. 49 is a side view of another surgical trocar with an integral cutting tip as according to a preferred embodiment of this invention;

FIG. 50 is a cross-sectional view of another cutting tip as according to this invention;

FIG. 51 is an enlarged view of a cutting edge from the cross-sectional view of FIG. 50;

FIG. 52 is a cross-sectional view of another cutting tip as according to this invention;

FIG. 53 is an enlarged view of a cutting edge from the cross-sectional view of FIG. 51;

FIG. 66 is a side view of another cutting tip as according to this invention;

FIG. 67 is a cross-sectional view of the cutting tip as illustrated in FIG. 66 taken along line 67—67;

FIG. 68 is an exploded side view of the cutting tip as according to the preferred embodiment of this invention as illustrated in FIG. 66 showing the cutting tip with the tip blades removed;

FIG. 69 is a side view of another cutting tip as according to this invention;

FIG. 70 is a top view of the cutting tip as illustrated in FIG. 69;

FIG. 71 is a cross-sectional view of the cutting tip as illustrated in FIG. 69 taken along line 71—71;

FIG. 72 is a cross-sectional view of the cutting tip as illustrated in FIG. 69 taken along line 72—72;

FIG. 77 is a side view of another cutting tip as according to this invention;

FIG. 78 is a top view of the cutting tip as illustrated in FIG. 77;

FIG. 79 is a top view of another cutting tip as according to this invention;

FIG. 80 is a top view of another cutting tip as according to this invention;

FIG. 81 is a top view of another cutting tip as according to this invention;

FIG. 82 is a side view of another cutting tip as according to this invention;

FIG. 83 is a top view of the cutting tip as illustrated in FIG. 82;

FIG. 84 is an exploded side view of the cutting tip as illustrated in FIG. 82 showing two tip blades detached from the cutting tip;

FIG. 85 is a side view of a blade-opening arrowhead with a cutting tip as according to a preferred embodiment of this invention, showing the pivotal blades in the open position;

FIG. 86 is a side view of another blade-opening arrowhead similar to the blade-opening arrowhead as illustrated in FIG. 85 except for the cutting tip is integral with the arrowhead body.

FIG. 87 is a cross-sectional view of the cutting tip as illustrated in FIG. 86 taken along line 87—87;

FIG. 88 is a cross-sectional view of another cutting tip as according to this invention;

FIG. 100 is a side view of an arrowhead body and cutting tip as according to this invention;

FIG. 101 is a partially sectioned side view of the assembled arrowhead components as illustrated in FIG. 100;

FIG. 102 shows another tip blade as according to another preferred embodiment of this invention;

FIG. 114 is a top view of another cutting tip as according to this invention;

FIG. 115 is a side view of the cutting tip of this invention as illustrated in FIG. 114;

FIG. 116 is a top view of another cutting tip as according to this invention;

FIG. 117 is a side view of the cutting tip of this invention as illustrated in FIG. 116.

DETAILED DESCRIPTION OF THE PREFERRED EMBODIMENTS

Figure 3:
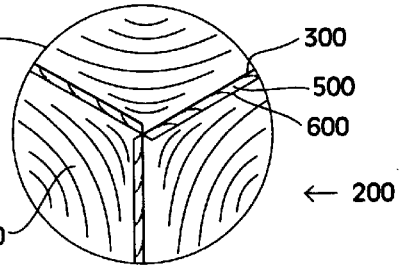
FIG. 3 is a top view of the cutting tip of FIG. 1.
Figure 2:
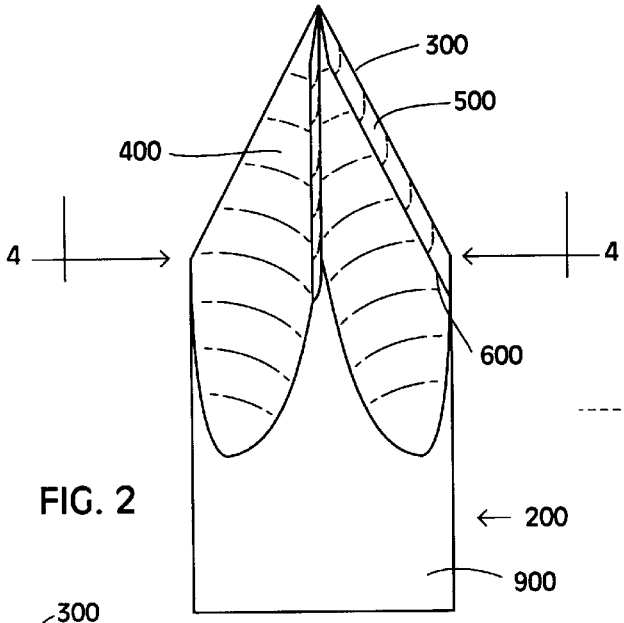
FIG. 2 is another side view of the cutting tip of FIG. 1.
Figure 1:
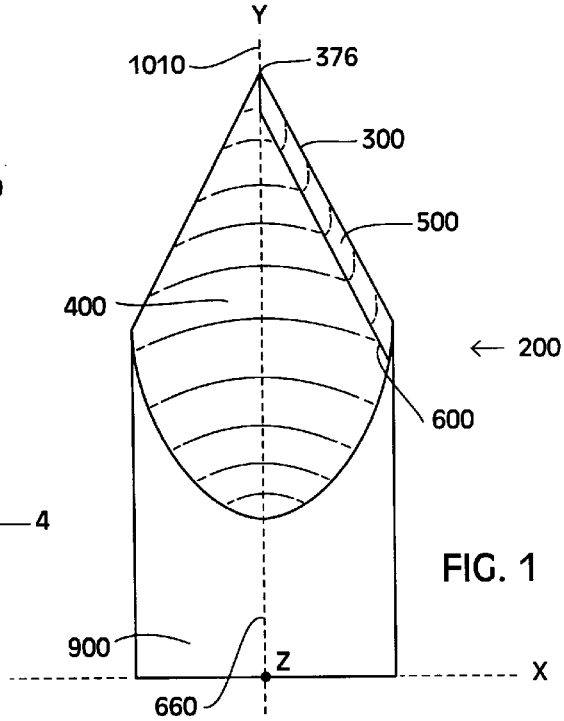
FIG. 1 is a side view of a cutting tip according to one preferred embodiment of this invention.
Figure 4:
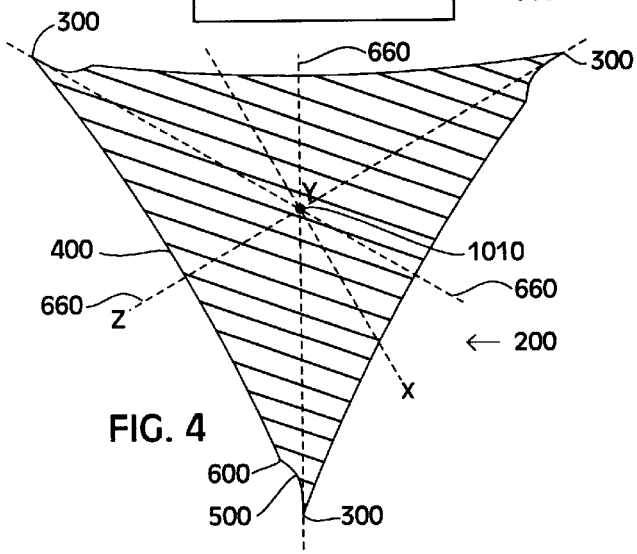
FIG. 4 is a cross-sectional view of the cutting tip of FIG. 1 taken along line 4—4.
Figure 5:
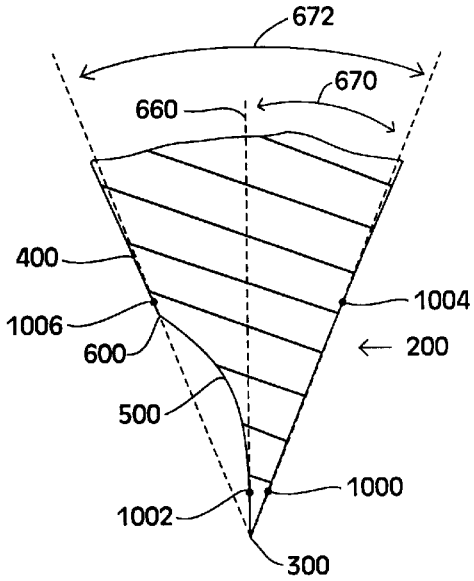
FIG. 5 is an enlarged view of a cutting edge from the cross-sectional view of FIG. 4.

FIGS. 1–5 illustrate a preferred embodiment of this invention, wherein a cutting tip 200 has three hollow ground facets 400-400-400. Each facet 400 is ground upon a barrel section 900 of cutting tip 200. Cutting tip 200 tapers to a pointed apex 376 at its forward leading end as illustrated in FIG. 1. Each facet 400 has a bevel 500 ground thereon. Bevels 500-500-500 create a sharper cutting edge 300 at the facet junctures of cutting tip 200 than is attainable by a conventional trocar tip having only hollow ground facets, while allowing cutting tip 200 to retain sufficient structural facet strength to crush/split heavy bone and easily push penetrated material from its cutting path. Each facet 400 has a pair of facet boundaries. Each facet boundary is defined by a cutting edge 300 where a facet 400 adjoins an adjacent facet 400. A facet 400 and other facets of the other preferred cutting tip embodiments of this invention is therefore generally defined as the cutting tip structure between the pair of facet boundaries or cutting edges of the respective facet. Therefore each bevel is part of its accompanying facet. Each bevel 500 creates a bevel boundary 600 upon its corresponding facet 400. Each bevel boundary 600 marks the location on each facet 400 where the slope of the corresponding facet 400 changes, as is readily determined by observation of a cross-sectional view of cutting tip 200 such as is illustrated in FIG. 4. The cross-sectional views of cutting tip 200 as shown in FIGS. 4 & 5 are taken in a plane perpendicular to a central longitudinal axis 1010 of cutting tip 200. Central longitudinal axis 1010 is collinear with the Y-axis of a Cartesian X-Y-Z axis system as illustrated in FIGS. 1 & 4. A facet bisecting plane 660 as also illustrated in FIGS. 1 & 4 bisects each facet 400 into two longitudinal halves. Each bevel 500 of cutting tip 200 is substantially on only one bisected side of its corresponding facet 400. As illustrated in FIG. 1 bevel 500 is on the right side of corresponding bisecting plane 660. As also illustrated in FIG. 1 facet bisecting plane 660 is coplanar with the Y-Z plane (coming out of the page).

As illustrated in FIG. 5 an enlarged cross-sectional view of one of the cutting edges 300 of cutting tip 200 clearly shows that a proximal angle 670 has an angle of measure that is less than the angle of measure of a distal angle 672 which therefore gives each cutting edge 300 of cutting tip 200 a true cutting edge and therefore its razor or scalpel sharpness, while retaining the optimally desired facet structure. A true cutting edge is a cutting edge that has a small enough angle between opposing structure such as facets or sides so as to make it as sharp as a razor blade or scalpel blade. It is within the desired results of this invention to provide cutting tips, such as three faceted hollow ground trocar tips that have such a true cutting edge located at each facet juncture. However, it is apparent that obtaining such a fine or small angle so as to produce a true cutting edge between opposing facets or other structures of the cutting tips as according to this invention is not of necessity a requirement for all cutting tips as according to this invention, but rather the creation of a finer or sharper edge than prior art cutting tips possess at their facet junctures and/or at their other structural sections. Proximal angle 670 has preferably an angular measure of between 10 and 35 degrees, but is not intended to be limited thereto. Proximal angle 670 is determined by measuring the angle in a plane perpendicular to central longitudinal axis 1010 of cutting tip 200 between a pair of proximal angle measuring reference points 1000 & 1002 and cutting edge 300. Distal angle 672 is determined by measuring the angle in the same perpendicular plane to central longitudinal axis 1010 of cutting tip 200 between a pair of distal angle measuring reference points 1004 & 1006 and cutting edge 300.

It is apparent that the method of determining the angle that adjoining facets, bevels or their equivalents are offset from each other with respect to the shape of their corresponding cutting tips and cutting edges as according to this invention may not have to be referenced from the corresponding cutting edge it self.

Proximal angle 670 and other proximal angles or their equivalents as according to the desired results of this invention which create an angle of measure that is less than distal angle 672 or other similar corresponding distal angles or their equivalents as according to this invention may be any angle that has angle measuring reference points located a distance from their corresponding cutting edge less than the distance their corresponding bevel boundary is from the cutting edge, as referenced in a plane perpendicular to the central longitudinal axis of the respective cutting tip. Distal angle 672 and other distal angles or their equivalents as according to the desired results of this invention which create an angle of measure that is greater than proximal angle 670 or other similar proximal angles or their equivalents as according to this invention therefore may be any angle that has angle measuring reference points located a distance from their corresponding cutting edge not less than the distance their corresponding bevel boundary is from the cutting edge, as referenced in a plane perpendicular to the central longitudinal axis of the respective cutting tip.

It is apparent that each point of a pair of angle measuring reference points used to determine the angle of measure, and therefore the angular offset of opposing cutting tip structural sections, whether a proximal angle or a distal angle as according to this invention, need not necessarily be the same distance from their corresponding cutting edge.

FIGS. 6–11 illustrate examples of types of devices that have a leading penetrating end used for penetrating substances which cutting tip 200 or other cutting tips as according to this invention can be associated with as according to the scope of this invention. FIG. 6 illustrates a fixed-blade arrowhead 702 that has cutting blades 722-722-722 and cutting tip 200 removably attached to an arrowhead body 732. FIGS. 7 & 8 illustrate a blade-opening arrowhead 700 that has pivotal cutting blades 720-720-720 and cutting tip 200 removably attached to an arrowhead body 730. FIG. 7 shows pivotal blades 720-720-720 in the closed or in-flight position, whereas FIG. 8 shows pivotal blades 720-720-720 in the open cutting position. FIG. 9 shows a blade-opening arrowhead 704 similar to blade-opening arrowhead 700 as illustrated in FIGS. 7 & 8 except for a cutting tip 204 is integrally attached with an arrowhead body 731. FIG. 10 illustrates a surgical trocar 706 that has a cannula 740 or trocar tube, a mandrel shank 744 or trocar obturator shank with cutting tip 200 removably attached thereto. FIG. 11 illustrates another surgical trocar 708 similar to surgical trocar 706 except for a cutting tip 202 is integrally attached with a mandrel shank 742.

The cutting tips according to this invention are preferably fabricated from metal stock material such as 400 series stainless steels, titanium alloys—including beta alloys, ferrous steels and carbides, but may be fabricated in their entirety or in part from other metals and non-metals such as organic polymers, composites or any combination of such materials or any other plausible materials.

It is apparent that friction reducing elements such as polytetrafloroethylene (PTFE) may be applied to the cutting tips of this invention, especially to the cutting tips fabricated of metal, to enhance their penetrating qualities.

Figures 12, 13, 14, 15, 16, 17, 18, 19:
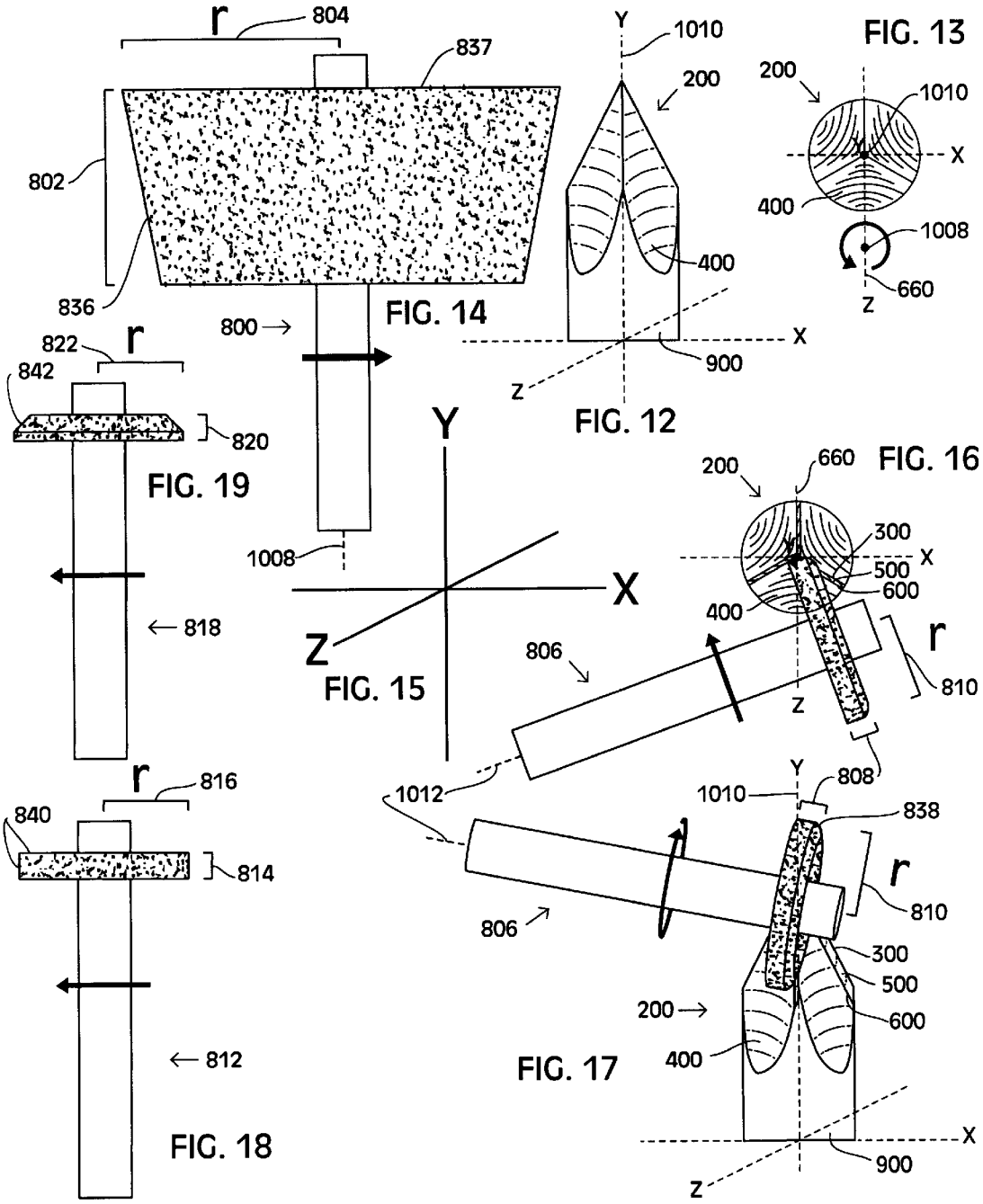
FIG. 12 is a side view of a three faceted hollow ground cutting tip.
FIG. 13 is a top view of the cutting tip as illustrated in FIG. 12.
FIG. 14 is a side view of a grinding wheel.
FIG. 15 is an illustration of the three dimensions as depicted with a Cartesian X-Y-Z axis system.
FIG. 16 is a top view of the cutting tip as illustrated in FIG. 13 showing a grinding wheel grinding a bevel on the cutting tip.
FIG. 17 is a side view of the cutting tip and grinding wheel as illustrated in FIG. 16.
FIG. 18 is a side view of another grinding wheel.
FIG. 19 is a side view of another grinding wheel.

FIGS. 12–17 illustrate in part a method of manufacturing cutting tip 200. FIG. 12 shows a conventional three faceted hollow ground trocar tip, that had its facets 400-400-400 ground by a grinding wheel 800 as illustrated in FIG. 14. Grinding wheel 800 has a radius of rotation 804, an axial thickness 802 and an exterior circumferential profile 836. Grinding wheel 800 is a type of rotational machining tool as according to this invention, because it rotates about an axis or spins and when shaping or forming objects. Other rotational machining tools as according to this invention comprise mill cutter heads, sanding wheels and any other type of shape forming device that rotates around at least one axis. In FIG. 14 radius of rotation 804 is depicted as the greatest radius of grinding wheel 800, but it is apparent that the radius of rotation 804 of grinding wheel 800 and the radiuses of rotation of other grinding wheels and rotational machining tools as according to this invention may be any actual radial length possessed by the rotational machining tool or grinding wheel, since such grinding wheels and/or rotational machining tools may have changing radial lengths throughout their axial thickness as does grinding wheel 800. The exterior circumferential profile of a rotational machining tool of this invention refers to surface shape of the part of the rotational machining tool that is actually contacting the object being formed, manufactured or ground. Although grinding wheel 800 forms each hollow ground facet 400 of cutting tip 200 by exterior circumferential profile 836 section of grinding wheel 800 removing cutting tip stock material during the grinding process, it is apparent that a section 837 of grinding wheel 800 could be used to grind or fabricate a facet, particularly a flat facet, of a cutting tip as according to this invention wherein section 837 would be an exterior circumferential profile.

FIG. 13 illustrates that the axis of rotation 1008 of grinding wheel 800, when grinding wheel 800 is grinding a facet 400 upon cutting tip 200, is substantially parallel to central longitudinal axis 1010 or the Y-axis, and is perpendicular to both the X-axis and Z-axis. Axis of rotation 1008 of grinding wheel 800, when grinding wheel 800 is grinding each facet 400 upon cutting tip 200, is therefore not inclined relative to any of the X, Y, or Z axises nor any of the three dimensions—their corresponding two dimensional planes; X-Z, X-Y, Y-Z. The term inclined as according to this invention has the intended meaning of being neither perpendicular nor parallel.

Axis of rotation 1008 of grinding wheel 800 when grinding wheel 800 is grinding each facet 400 upon cutting tip 200, is orientated with respect to the X-Y-Z axis system of cutting tip 200 in a specific spatial orientation. A spatial orientation as according to this invention refers to the three-dimensional occupancy of space, and particularly to the three-dimensional occupancy of space that axises of rotation of grinding wheels and/or rotational machining tools are oriented with respect to a corresponding Cartesian X-Y-Z axis system of a corresponding cutting tip.

FIGS. 16 & 17 show another grinding wheel 806 grinding a bevel 500 upon one of the facets 400 after grinding wheel 800 formed facets 400-400-400. Grinding wheel 806 has a radius of rotation 810, an axial thickness 808 and an exterior circumferential profile 838. The radius of rotation 810 of grinding wheel 806 is of a different length of radius than the radius of rotation 804 of grinding wheel 800. The axial thickness 808 of grinding wheel 806 is of a different thickness than the axial thickness 802 of grinding wheel 800. The exterior circumferential profile 838 of grinding wheel 806 is also of a different profile than the exterior circumferential profile 836 of grinding wheel 800.

As is illustrated in FIGS. 16 & 17 the axis of rotation 1012 of grinding wheel 806 is inclined relative to each of the X, Y, and Z axises of a Cartesian X-Y-Z axis system and therefore also inclined to the corresponding X-Y, X-Z, and Y-Z planes when grinding wheel 806 is forming each bevel 500 upon cutting tip 200. Therefore, the axis of rotation 1012 of grinding wheel 806 when forming a bevel 500 upon a particular facet 400 of cutting tip 200 is oriented with respect to at least one of the X-Y-Z axises and corresponding three dimensional planes in a different relation or spatial orientation than the spatial orientation axis of rotation 1008 of grinding wheel 800 is oriented with respect to the X-Y-Z axises and three dimensional planes when forming the particular portion of the facet—the primary structure or the hollow ground facets. Each bevel 500 is substantially on only one bisected side of its corresponding facet 400, thus grinding wheel 806 when forming a bevel 500 upon a facet 400 is removing facet material or cutting tip stock material from only one bisected side of that facet 400 for a substantial majority of the time that grinding wheel 806 is forming the particular bevel 500. This is clearly illustrated in FIG. 16 where the bevel 500 grinding wheel 806 is shown forming is substantially completely on the right side of facet bisecting plane 660, which bisecting plane 660 happens to be aligned coplanar with the Y-Z plane (coming out of the page) as seen in FIG. 16. Removing facet material or cutting tip stock material with a grinding wheel or other rotational machining tool when forming a portion of a facet such as when grinding wheel 806 is forming a bevel 500, is in essence cutting or making a cut from the cutting tip stock material when fabricating it as according to this invention.

FIG. 18 shows a grinding wheel 812 which has a radius of rotation 816, an axial thickness 814 and an exterior circumferential profile 840. FIG. 19 shows a grinding wheel 818 which has a radius of rotation 822, an axial thickness 820 and an exterior circumferential profile 842. Both grinding wheels 812 and 818 could be used to grind bevels similar to bevels 500-500-500 upon facets 400-400-400 of cutting tip 200, however due to their different exterior circumferential profiles and potentially different axial thicknesses, potentially different radii of rotation and the different possible relations their axises of rotation can be oriented with respect to the three dimensions of the X-Y-Z axises of corresponding cutting tips, the bevels grinding wheels 812 and 818 would grind could have a variety of different shapes, slopes and/or curvatures than that of bevels 500-500-500 as shown on cutting tip 200.

Figure 21:
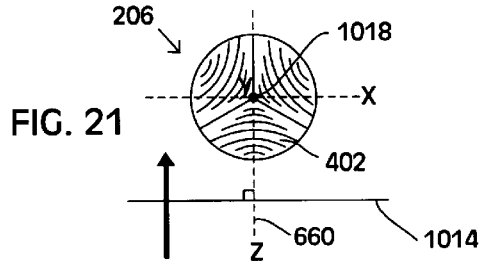
FIG. 21 is a top view of the cutting tip as illustrated in FIG. 20.
Figure 23:
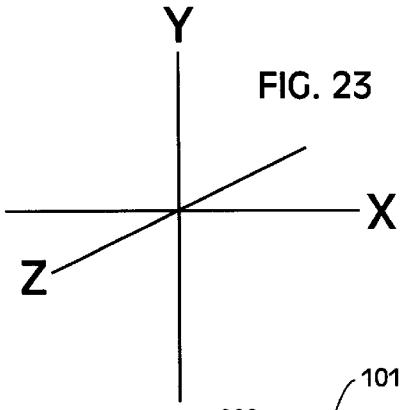
FIG. 23 is an illustration of the three dimensions as depicted with a Cartesian X-Y-Z axis system.
Figure 22:
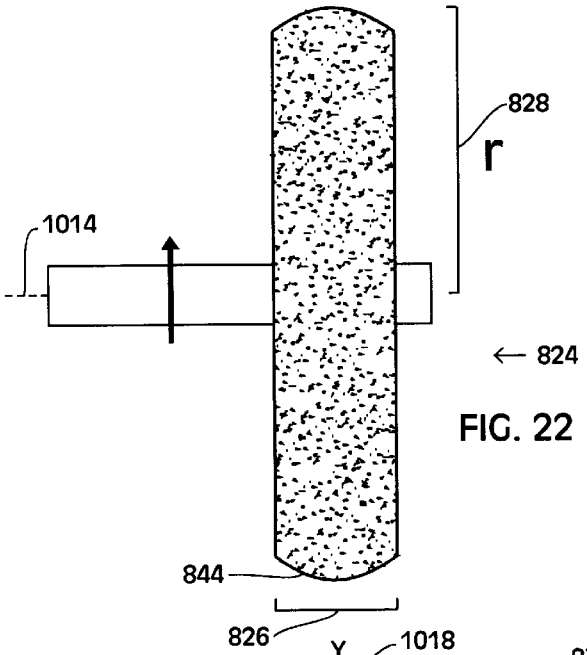
FIG. 22 is a side view of another grinding wheel.
Figure 24:
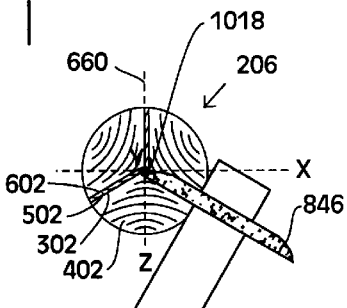
FIG. 24 is a top view of the cutting tip as illustrated in FIG. 21 showing a grinding wheel grinding a bevel on the cutting tip.
Figure 25:
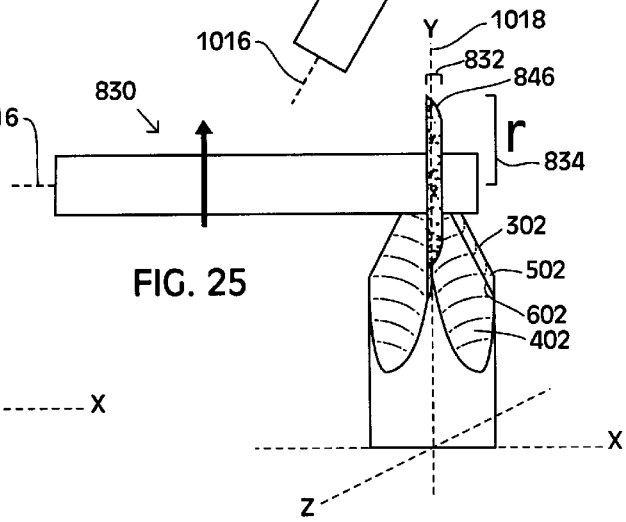
FIG. 25 is a side view of the cutting tip and grinding wheel as illustrated in FIG. 24.

FIGS. 20–25 illustrate in part another method of manufacturing a cutting tip 206 that is similar to cutting tip 200 and similar to the method as disclosed in FIGS. 12–17 except the method of manufacturing cutting tip 206 as illustrated in FIGS. 20–25 first entails grinding the hollow ground trocar tip facets 402-402-402 by a grinding wheel 824 as illustrated in FIG. 22 wherein the axis of rotation 1014 of grinding wheel 824 is oriented substantially perpendicular to central longitudinal axis 1018 of cutting tip 206 when grinding each facet 402 thereon. Grinding wheel 824 has a radius of rotation 828, an axial thickness 826, and an exterior circumferential profile 844. Axis of rotation 1014 of grinding wheel 824 is oriented in a specific spatial orientation when grinding a hollow ground facet 402 on cutting tip 206, particularly axis of rotation 1014 is spatially oriented substantially perpendicular to both a central longitudinal axis 1018 or the Y-axis and to the Z-axis, while being substantially parallel to the X-axis. Axis of rotation 1014 of grinding wheel 824, when grinding wheel 824 is grinding each facet 402 upon cutting tip 206, is therefore not inclined relative to any of the X-Y-Z axises nor any of the three dimensions. FIGS. 24 & 25 show that another grinding wheel 830 next grinds a bevel 502 upon each of the facets 402 after grinding wheel 824 formed facets 402-402-402. Bevels 502-502-502 create a sharper cutting edge 302 at the facet junctures of cutting tip 206 than is attainable by a conventional trocar tip having only hollow ground facets as shown for example in FIGS. 20 & 21, while allowing cutting tip 206 to retain sufficient structural facet strength to crush/split heavy bone and easily push penetrated material from its cutting path. Each bevel 502 creates a bevel boundary 602 upon its corresponding facet 402. Grinding wheel 830 has a radius of rotation 834, an axial thickness 832 and an exterior circumferential profile 846. The radius of rotation 834 of grinding wheel 830 is of a different length of radius than the radius of rotation 828 of grinding wheel 824. The axial thickness 832 of grinding wheel 830 is of a different thickness than the axial thickness 826 of grinding wheel 824. The exterior circumferential profile 846 of grinding wheel 830 is also of a different profile than the exterior circumferential profile 844 of grinding wheel 824.

As is illustrated in FIGS. 24 & 25 axis of rotation 1016 of grinding wheel 830 is inclined relative to each of the X, and Z axises in a specific spatial orientation and therefore to two of the corresponding three dimensional planes -the X-Y, and Y-Z planes- when grinding wheel 830 is forming each bevel 502 thereon. However, axis of rotation 1016 of grinding wheel 830 is perpendicular to the Y-axis or central longitudinal axis 1018 of cutting tip 206 and is parallel to the X-Z plane when grinding wheel 830 is forming each bevel 502. Therefore, the axis of rotation 1016 of grinding wheel 830 when forming a bevel 502 upon a particular facet 402 of cutting tip 206 is oriented with respect to at least one of the X-Y-Z axises and corresponding three dimensional planes in a different relation or spatial orientation than the spatial orientation axis of rotation 1014 of grinding wheel 824 is oriented with respect to the X-Y-Z axises and three dimensional planes when forming the particular facet. Each bevel 502 is substantially on only one bisected side of its corresponding facet 402, thus grinding wheel 830 when forming a bevel 502 upon a facet 402 is removing facet material or cutting tip stock material from only one bisected side of facet 402 for a substantial majority of the time that grinding wheel 830 is forming the particular bevel 502. This is clearly illustrated in FIG. 24 where the bevel 502 grinding wheel 830 is shown forming is substantially completely on the right side of facet bisecting plane 660, which bisecting plane 660 happens to be aligned coplanar with the Y-Z plane (coming out of the page) as seen in FIG. 24.

Figure 20:
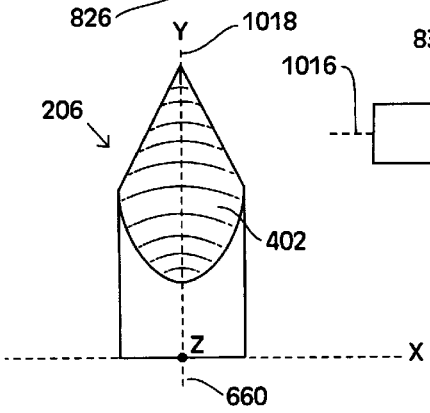
FIG. 20 is a side view of another three faceted hollow ground cutting tip.

It is apparent that the facets of the cutting tips as according to this invention whether concave/hollow ground or of some other shape may have each primary facet structure such as hollow ground facets 402-402-402 of the conventional trocar tip as illustrated in FIGS. 20 & 21, formed by rotational machining tools and/or grinding wheels where the axis of rotation of the rotational machining tool or grinding wheel forming such primary facet structure is substantially inclined relative to one or more of the Cartesian X-Y-Z axises and their corresponding three dimensional planes as has been disclosed in this specification, when forming the corresponding portion of each facet. The term primary facet structure refers generally but not limited thereto, to the facet before a bevel or bevels as according to this invention are formed or ground thereon so as to create a razor sharp cutting edge as is according to the desired results of this invention. Such cutting tips having the primary facet structures or at least a part of a facet formed by a grinding wheel or rotational machining tool whose axis of rotation is inclined with respect to at least one or more of the X-Y-Z axises would then have a bevel or bevels as according to this invention formed on each facet by a grinding wheel or rotational machining tool which would have possibly a different radius of rotation, a different axial thickness, or a different exterior circumferential profile than the grinding wheel or rotational machining tool that formed the primary facet structure. Also, the grinding wheel or rotational machining tool forming the bevel or bevels on the primary facet structure could possibly have its axis of rotation when forming the bevel(s) on a facet of a respective cutting tip, oriented with respect to the X-Y-Z axises in a different manner or relation than the inclined manner or relation the grinding wheel or rotational machining tool that formed the primary facet structure of that facet was oriented with respect to the X-Y-Z axises when forming the primary facet structure as according to this invention. Such different manner or relation of orientation of the axis of rotation of the rotational machining tool or grinding wheel when forming the bevel(s) with respect to the X-Y-Z axises could be either inclined or non-inclined relative to one or more of the X-Y-Z axises and the corresponding three dimensional planes.

Figures 26, 27, 28, 29, 30, 31, 32, 33, 34, 35:
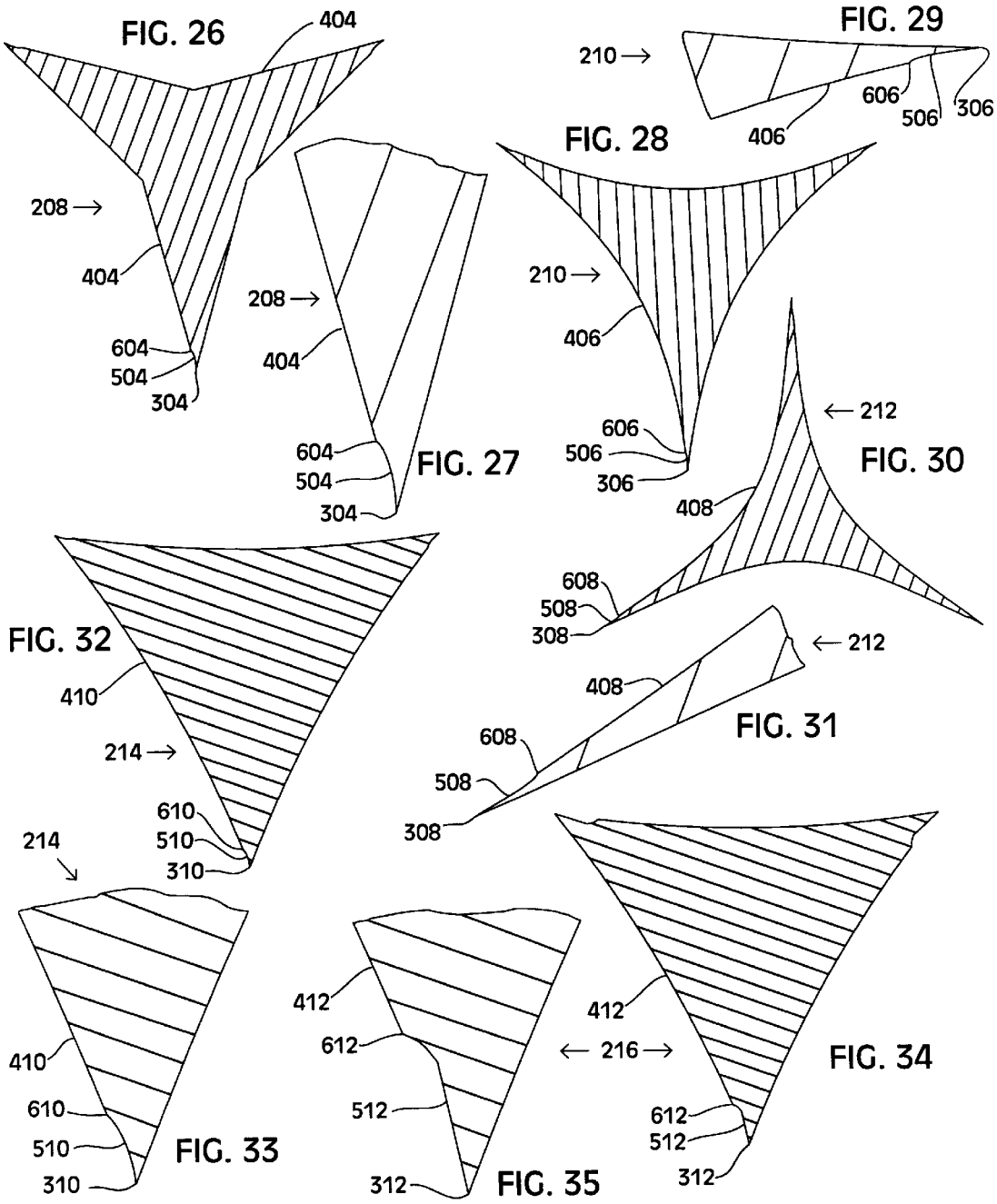
FIG. 26 is a cross-sectional view of another cutting tip as according to this invention.
FIG. 27 is an enlarged view of a cutting edge from the cross-sectional view of FIG. 26.
FIG. 28 is a cross-sectional view of another cutting tip as according to this invention.
FIG. 29 is an enlarged view of a cutting edge from the cross-sectional view of FIG. 28.
FIG. 30 is a cross-sectional view of another cutting tip as according to this invention.
FIG. 31 is an enlarged view of a cutting edge from the cross-sectional view of FIG. 30.
FIG. 32 is a cross-sectional view of another cutting tip as according to this invention.
FIG. 33 is an enlarged view of a cutting edge from the cross-sectional view of FIG. 32.
FIG. 34 is a cross-sectional view of another cutting tip as according to this invention.
FIG. 35 is an enlarged view of a cutting edge from the cross-sectional view of FIG. 34.
Figure 38:
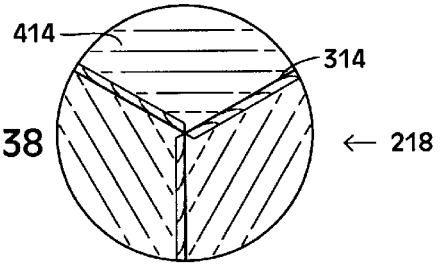
FIG. 38 is a top view of the cutting tip as illustrated in FIG. 36.
Figure 36:
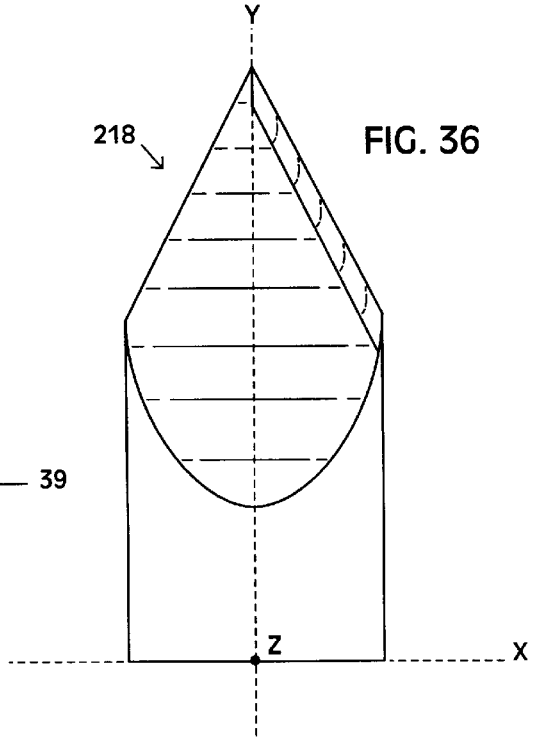
FIG. 36 is a side view of another cutting tip as according to this invention.
Figure 37:
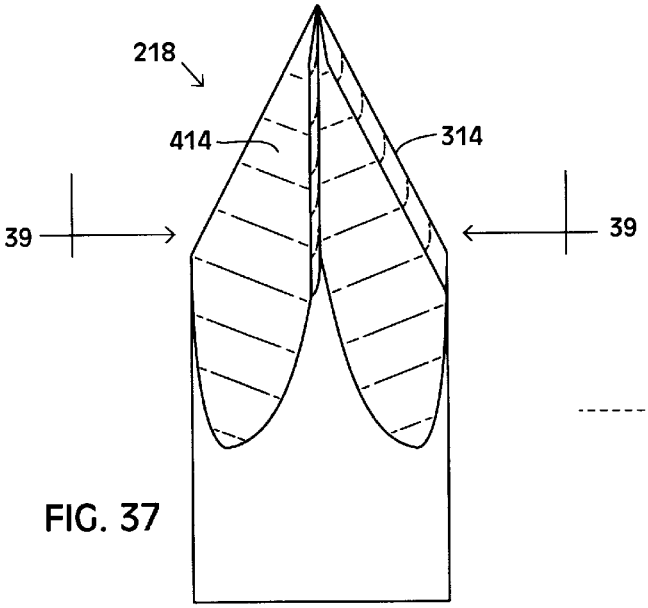
FIG. 37 is another side view of the cutting tip as illustrated in FIG. 36.

FIGS. 26–35 illustrate other preferred cutting tip embodiments as according to the cutting tips of this invention that have at least a part of their facets substantially concave—which may have been formed from hollow grinding and/or other fabrication methods. FIGS. 26 & 27 show cross-sectional views of a three sided cutting tip 208 having facets 404-404-404, cutting edges 304-304-304, bevels 504-504-504, and bevel boundaries 604-604-604. FIGS. 28 & 29 show cross-sectional views of a three sided cutting tip 210 having facets 406-406-406, cutting edges 306-306-306, bevels 506-506-506, and bevel boundaries 606-606-606. FIGS. 30 & 31 show cross-sectional views of a three sided cutting tip 212 having facets 408-408408, cutting edges 308-308-308, bevels 508-508-508, and bevel boundaries 608-608-608. FIGS. 32 & 33 show cross-sectional views of a three sided cutting tip 214 having facets 410-410-410, cutting edges 310-310-310, bevels 510-510-510, and bevel boundaries 610-610-610. FIGS. 34 & 35 show cross-sectional views of a three sided cutting tip 216 having facets 412-412-412, cutting edges 312-312-312, bevels 512-512-512, and bevel boundaries 612-612-612.

As is apparent from cutting tips 210 & 212 as illustrated in FIGS. 28–31 regardless of how small the distal angle is or how dished-out the concave facets are, a finer or narrower proximal angle is attainable at the cutting edge or juncture of adjoining facets by forming a bevel thereon as according to this invention, and therefore provides a sharper cutting edge than would of been attainable had the bevel or bevels not been formed.

Figure 39:
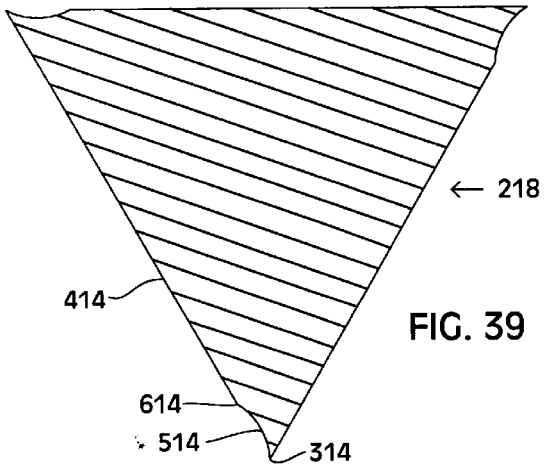
FIG. 39 is a cross-sectional view of the cutting tip as illustrated in FIG. 37 taken along line 39—39.
Figure 40:
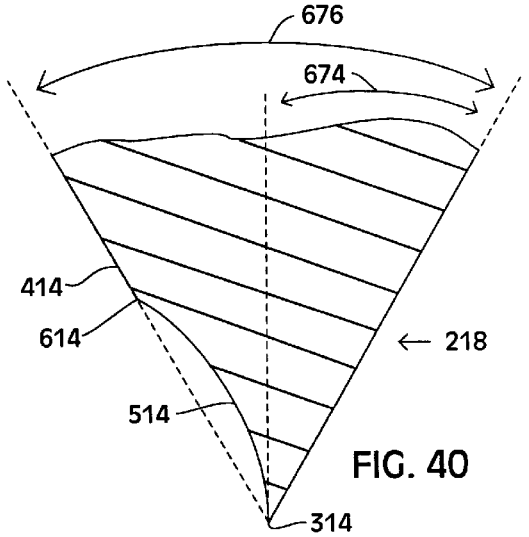
FIG. 40 is an enlarged view of a cutting edge from the cross-sectional view of FIG. 39.
Figure 43:
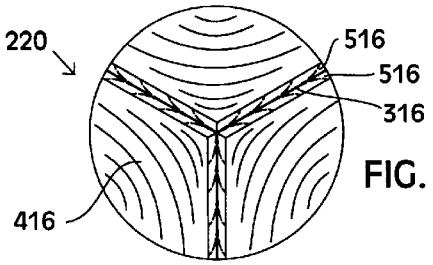
FIG. 43 is a top view of the cutting tip as illustrated in FIG. 41.
Figure 42:
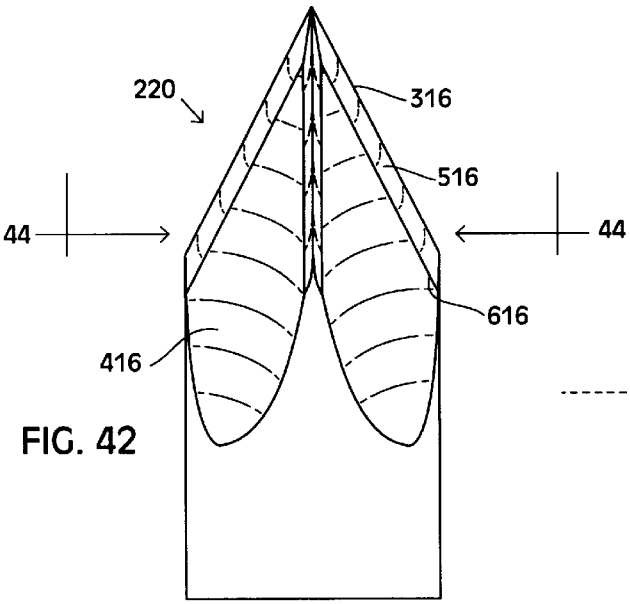
FIG. 42 is another side view of the cutting tip as illustrated in FIG. 41.
Figure 41:
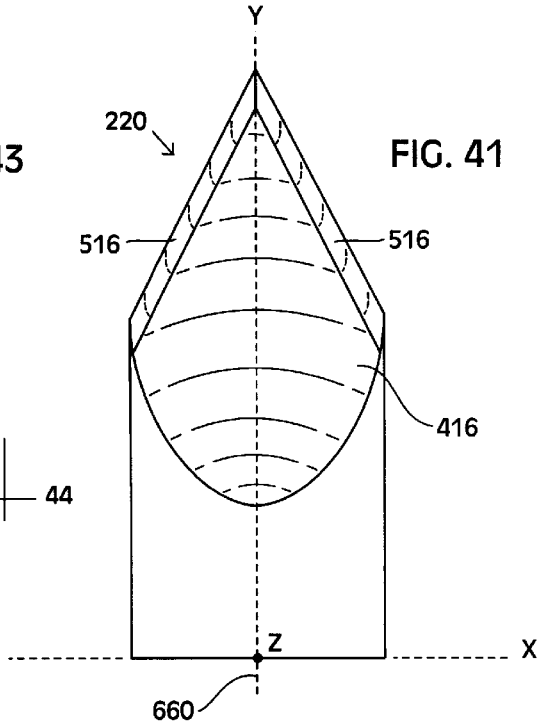
FIG. 41 is a side view of another cutting tip as according to this invention.
Figure 44:
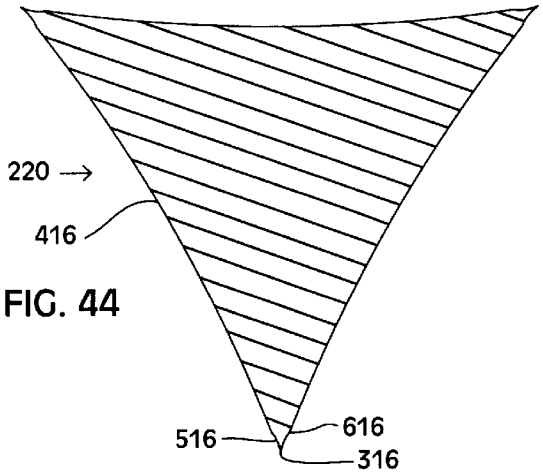
FIG. 44 is a cross-sectional view of the cutting tip as illustrated in FIG. 42 taken along line 44—44.

FIGS. 36–40 illustrate a cutting tip 218. Cutting tip 218 has facets 414-414-414, cutting edges 314-314-314, bevels 514-514-514, and bevel boundaries 614-614-614. Cutting tip 218 is similar to the cutting tips described above except that the facets 414-414-414 of cutting tip 218 are substantially flat as is best seen in FIG. 39. FIG. 40 shows that a proximal angle 674 has an angle of measure that is less than the angle of measure of a distal angle 676 as according to the proximal and distal angles of this invention and therefore gives cutting tip 218 sharper cutting edges 314-314-314 than it would of had if the bevels 514-514-514 had not been formed thereon. It is apparent that other proximal angles having an angle of measure that is greater than the angle of measure of proximal angle 674 are measurable by reference from other locations along bevel 514 of cutting tip 218. Such other proximal angles would still have an angle of measure that is less than the angle of measure of distal angle 676 as is according to this invention.

It is apparent that the shape or structure of the facets according to the cutting tips of this invention may be concave, flat, convex or have other complex geometries as according to the scope of this invention.

Figure 45:
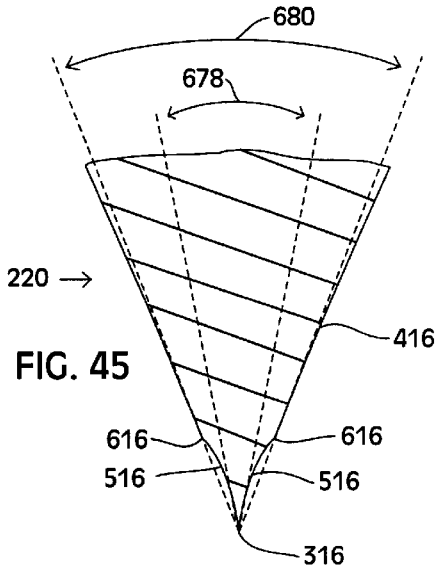
FIG. 45 is an enlarged view of a cutting edge from the cross-sectional view of FIG. 44.

FIGS. 41–45 illustrate a cutting tip 220. Cutting tip 220 has facets 416-416-416, cutting edges 316-316-316, bevels 516-516-516-516-516-516, and bevel boundaries 616-616-616-616-616-616. Cutting tip 220 has two bevels 516—516 formed upon each facet 416. It is apparent that more than one bevel may be formed upon each facet of the cutting tips as according to this invention. FIG. 45 shows that a proximal angle 678 has an angle of measure that is less than the angle of measure of a distal angle 680 as according to the proximal and distal angles of this invention and therefore gives cutting tip 220 sharper cutting edges 316-316-316 than it would of had if the bevels had not been formed thereon.

FIGS. 46–49 illustrate other arrowheads and surgical trocars having cutting tips as according to this invention at their leading penetrating ends. FIG. 46 illustrates a fixed-blade arrowhead 752 that has cutting blades 722-722-722 and cutting tip 220 removably attached to arrowhead body 732. FIG. 47 illustrates a blade-opening arrowhead 750 that has pivotal cutting blades 720-720-720 and cutting tip 222 integrally attached to or with arrowhead body 731. FIG. 48 illustrates a surgical trocar 754 that has a cannula 740 or trocar tube, a mandrel shank 744 or trocar obturator shank with cutting tip 220 removably attached thereto. FIG. 49 illustrates another surgical trocar 756 similar to surgical trocar 754 except for a cutting tip 224 is integrally attached with a mandrel shank 742.

FIGS. 50–53 illustrate other examples of cutting tips as according to this invention that have two bevels upon each facet such that one bevel of each adjoining facet communicates with each cutting edge. FIGS. 50–51 illustrate a cutting tip 226. Cutting tip 226 has flat facets 418-418-418, cutting edges 318-318-318, bevels 518-518-518-518-518-518, and bevel boundaries 618-618-618-618-618-618. FIGS. 52–53 illustrate a cutting tip 228. Cutting tip 228 also has flat facets 420-420-420, cutting edges 320-320-320, bevels 520-520-520-520-520-520, and bevel boundaries 620-620-620-620-620-620.

It is apparent that cutting tips as according to this invention could have facets that have only one bevel formed thereon while having other facets that have a plurality of bevels formed thereon.

Figures 54, 55, 56, 57, 58, 59, 60:
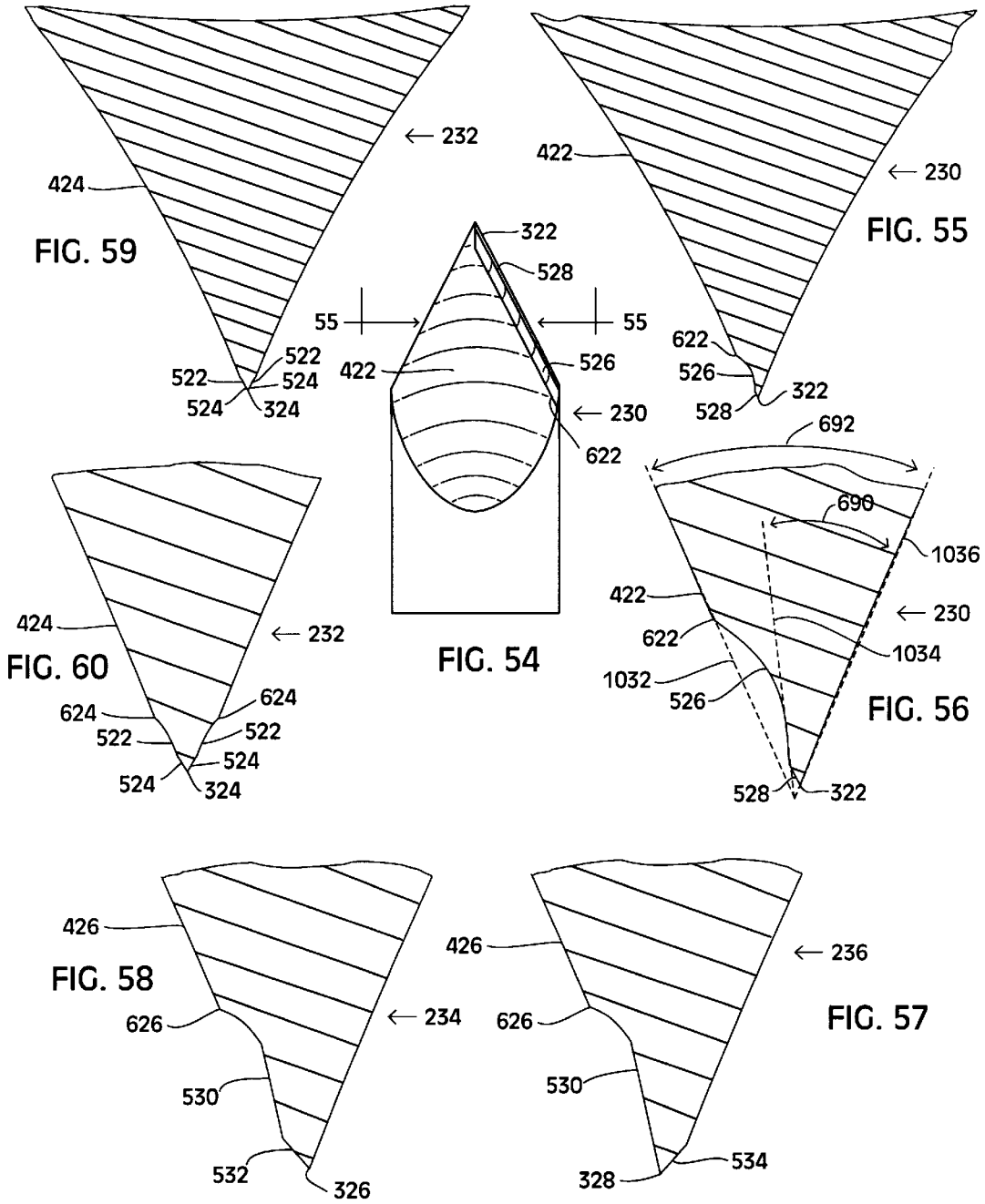
FIG. 54 is a side view of another cutting tip as according to a preferred embodiment of this invention showing a hone bevel.
FIG. 55 is a cross-sectional view of the cutting tip as illustrated in FIG. 54 taken along line 55—55.
FIG. 56 is an enlarged view of a cutting edge from the cross-sectional view of FIG. 55.
FIG. 57 is an enlarged view of a cutting edge from the cross-sectional view of another cutting tip as according to this invention showing another hone bevel.
FIG. 58 is an enlarged view of a cutting edge from the cross-sectional view of another cutting tip as according to this invention showing another hone bevel.
FIG. 59 is a cross-sectional view of another cutting tip as according to this invention.
FIG. 60 is an enlarged view of a cutting edge from the cross-sectional view of FIG. 59.

FIGS. 54–56 illustrate a cutting tip 230. Cutting tip 230 has hollow ground facets 422-422-422, cutting edges 322-322-322, bevels 526-526-526, hone bevels 528-528-528, and bevel boundaries 622-622-622. Hone bevels 528-528-528 serve to provide cutting tip 230 and other cutting tips as according to this invention that have hone bevels or their equivalents with a slightly stronger cutting edge as is commonly done with razor blades, scalpels and other cutting knife type blades, which are generally fabricated from the process of strip grinding. As illustrated in FIG. 56 a proximal angle 690 has an angle of measure that is less than a distal angle 692 as according to this invention. The dotted lines 1032 & 1036 of angle 692 do not intersect each other at cutting edge 322 nor do the dotted lines 1036 & 1034 of angle 690 intersect each other at cutting edge 322. This is an example as according to this invention of how the method of determining the angle or angles that adjoining facets, bevels, other cutting tip structures or their equivalents are offset from each other with respect to the shape of their corresponding cutting tips and cutting edges as according to this invention, may not involve referencing from the corresponding cutting edge, but which still determine true angular offsets of such structures.

It is apparent that a proximal angle of less degrees in measure than a distal angle as according to this invention is attainable with cutting tip 230 and other similar preferred cutting tip embodiments of this invention having hone bevels despite the fact that each hone bevel, as for example hone bevels 528-528-528 of cutting tip 230, creates a wider angle than the corresponding proximal angle of the cutting tip in reference at a location closer to the corresponding cutting edge than the structure of the cutting tip that was used in reference to determine the angle of measure of the comparative proximal angle. Such a wider angle, or wider angles therefore could be determined as according to one measuring method by angular measuring reference points that are closer to corresponding cutting edges than the angular measuring reference points of the corresponding comparative proximal angle or proximal angles of the cutting tip and cutting edge in reference as has been defined in this specification.

FIGS. 57 & 58 illustrate a cutting tip 234 and a cutting tip 236. Cutting tips 234 & 236 are identical to each other in certain structural features such as they each have facets 426-426-426, bevels 530-530-530, and bevel boundaries 626-626-626. Cutting tips 234 & 236 however differ from each other in the location of their hone bevels and therefore the location of their cutting edges. Each hone bevel 532 of cutting tip 234 is located on the left side of its accompanying cutting edge 326 as seen when viewed from above in cross-section as depicted in FIG. 58, whereas each hone bevel 534 of cutting tip 236 is located on the right side of its accompanying cutting edge 328 as seen when viewed from above in cross-section as depicted in FIG. 57.

The bevel boundaries of the cutting tips as according to this invention generally define a location or boundary upon respective cutting tips where the structure of the cutting tip, particularly facets or area between cutting edges, change slope or change shape. Such change in slope or shape is generally best seen from cross-sectional views of the cutting tips but is also readily apparent from side views and top views of the respective cutting tips. It is apparent that the cutting tips as according to this invention having hone bevels or equivalents may also have hone bevel boundaries.

FIGS. 59 & 60 illustrate a cutting tip 232. Cutting tip 232 has facets 424-424-424, cutting edges 324-324-324, bevels 522-522-522-522-522-522, hone bevels 524-524-524-524-524-524 and bevel boundaries 624-624-624-624-624-624. As is clearly evident from the enlarged view of one of the cutting edges 324 of cutting tip 232 as illustrated in FIG. 60, each cutting edge 324 has two hone bevels 524—524 situated on opposite sides thereof.

Figures 61, 62, 63, 64, 65:
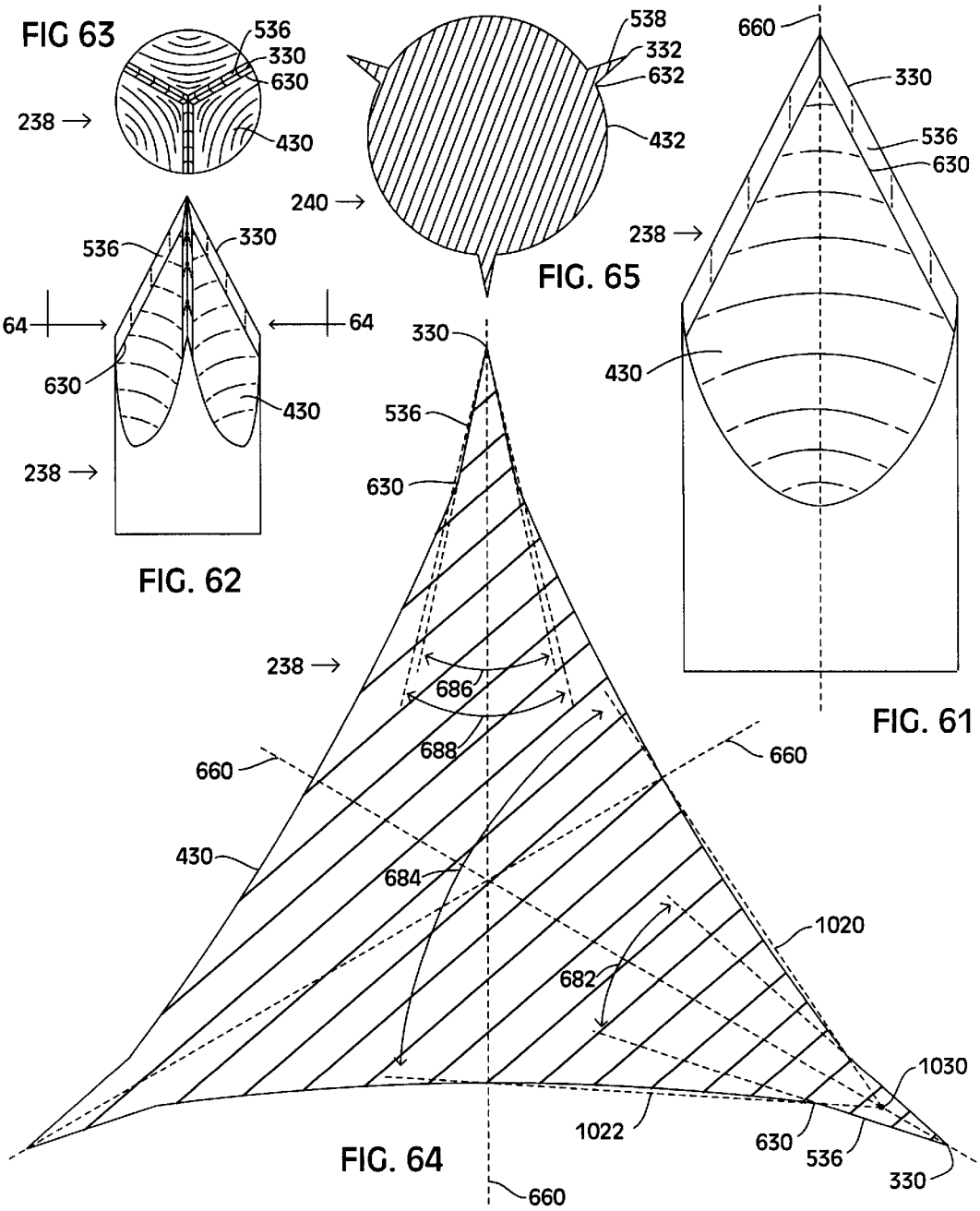
FIG. 61 is a side view of another cutting tip as according to this invention.
FIG. 62 is another side view of the cutting tip as illustrated in FIG. 61.
FIG. 63 is a top view of the cutting tip as illustrated in FIG. 61.
FIG. 64 is a cross-sectional view of the cutting tip as illustrated in FIG. 62 taken along line 64—64.
FIG. 65 is a cross-sectional view of another cutting tip as according to this invention.
Figure 73:
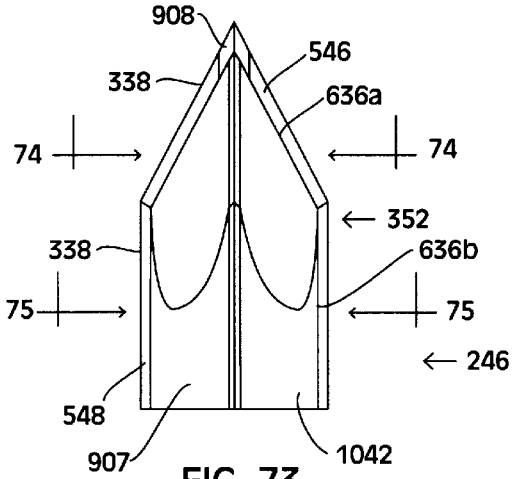
FIG. 73 is a side view of another cutting tip as according to this invention.
Figure 74:
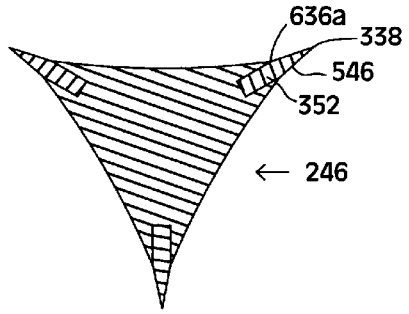
FIG. 74 is a cross-sectional view of the cutting tip as illustrated in FIG. 73 taken along line 74—74.
Figure 75:
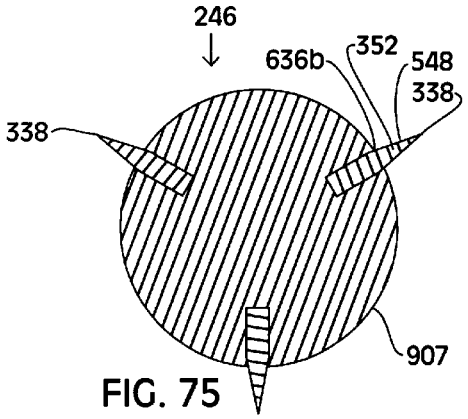
FIG. 75 is a cross-sectional view of the cutting tip as illustrated in FIG. 73 taken along line 75—75.

FIGS. 61–64 illustrate a cutting tip 238, yet another preferred embodiment as according to this invention. Cutting tip 238 has concave facets 430-430-430, cutting edges 330-330-330, flat planar bevels 536-536-536-536-536-536, and bevel boundaries 630-630-630-630-630-630. FIG. 64 illustrates that a proximal angle 686 has an angle of measure that is less than the angle of measure of a distal angle 688 as according to the proximal and distal angles of this invention and also that a proximal angle 682 has an angle of measure that is less than the angle of measure of a distal angle 684. Angles 682 & 684 of FIG. 64 illustrate another example showing that the manner of determining the angle of measure of a particular structure or section of a cutting tip as according to this invention is not limited exclusively to angular measuring reference points and distances they are displaced from their corresponding cutting edges. For example, even though dotted lines 1020 & 1022 of angle 684 intersect adjoining facets 430—430 at facet bisecting planes 660—660 and do not conjoin at a cutting edge 330 but rather at a point 1030 along one of the facet bisecting planes 660, which coincidently bisects angle 684 into two substantially equal halves, they accurately represent an angle that adjoining facets 430—430 are offset from each other with respect to the shape of a section of cutting tip 238 that is distal or further from the cutting edge than the corresponding bevel boundaries 630—630.

The term distal as used throughout this specification refers to being further away from whereas the term proximal refers to being closer to. Distal and proximal have been referenced from corresponding cutting edges with respect to proximal and distal angles, so therefore distal angles are determined from the angular offset of opposing cutting tip structures, such a facets and bevels, that are located a distance further from the cutting edge than opposing cutting tip structures that determine the angular offset of proximal angles, regardless of the cutting tip geometry, as has been discussed herein.

It is apparent that there exists a variety of angle measuring methods, some of which have been discussed herein, to determine that a particular section of a cutting tip, as according to this invention, which is located substantially closer to a corresponding cutting edge has a finer or narrower angle than a section of the same cutting tip located a distance substantially further from the same corresponding cutting edge, which generally but not limited to is determined as in a plane perpendicular to the central longitudinal axis of the respective cutting tip. Such cutting tips as according to the desired results of the cutting tips of this invention overcome deficiencies inherent in prior art cutting tips by providing a razor sharp cutting edge in combination with optimally desirable strong and durable facet structure.

FIG. 65 illustrates a cutting tip 240. Cutting tip 240 has convex facets 432-432-432, cutting edges 332-332-332, flat planar bevels 538-538-538-538-538-538, and bevel boundaries 632-632-632-632-632-632. Cutting tip 240 is similar to cutting tip 238 as illustrated in FIGS. 61–64, except cutting tip 240 has convex or outwardly bulging facets, and therefore is a generally conical shaped cutting tip.

Although the cutting tips as according to this invention that are fabricated by machining—i.e. screw machines, grinding etc.—are preferably fabricated from round bar or rod stock, such as 12 foot lengths of stainless steel bar, it is apparent that a step in the manufacturing process to produce cutting tips as according to this invention could involve impact swaging of pellets or slugs to form at least part of the primary shape or structure of a cutting tip, wherein after the razor sharp cutting edges and/or bevels could be ground thereon after hardening was completed. Impact swaging could allow cutting tips, as according to some of the preferred embodiments of this invention which have facet structures that are complex and costly to machine such as the convex facets 432-432-432 of cutting tip 240, to be economically and quickly produced.

It is apparent that flat bevels such as bevels 538 of cutting tip 240 as illustrated in FIG. 65 could be swaged or formed during impact swaging and that hone bevels or other bevels, such as curved bevels could then be ground or formed thereon to provide a sharper cutting edge as according to the desired results of this invention.

FIGS. 66–68 illustrate a cutting tip 242. Cutting tip 242 differs from the other cutting tips of this invention that have been heretofore disclosed in that cutting tip 242 has attachable tip blades 350-350-350, which each fit into a corresponding slot 910 of a metal tip body 1040 as is illustrated in FIG. 68. Tip blades 350-350-350 each have a pair of bevels 540—540 and a cutting edge 334. Each tip blade 350 abuts against a nipple 908 of tip body 1040 and against a pair of bevel boundaries 628—628 when attached thereto. Nipple 908 is preferably integral with tip body 1040. Tip blades 350-350-350 are preferably welded integrally to tip body 1040. It is apparent that tip blades 350-350-350 and other tip blades or their equivalents as according to this invention may be attached to tip bodies, whether of metal construction, polymer or of other materials or combinations thereof, by a variety of different methods including glueing, welding, molding, and by modifications in the shapes of the tip blades and/or tip bodies.

FIGS. 69–72 illustrate a cutting tip 244. Cutting tip 244 differs from the other cutting tips of this invention that have been heretofore disclosed in that cutting tip 244 has three integral cutting edges 336-336-336 that each extend substantially the full length of cutting tip 244 from the junctures between the facets rearward along a barrel section 906. A pair of bevel boundaries **634*a*—634*a* defines the boundary of a corresponding pair of bevels 542—542 with corresponding facets, as is illustrated in FIG. 71. Another pair of bevel boundaries 634***b*—634*b* defines the boundary of a pair of corresponding bevels 544—544 with barrel section 906, as is illustrated in FIG. 72. Cutting edge 336 between each pair of adjoining facets is coplanar or in-line with the section of cutting edge 336 that extends rearward upon barrel section 906.

Figure 76:
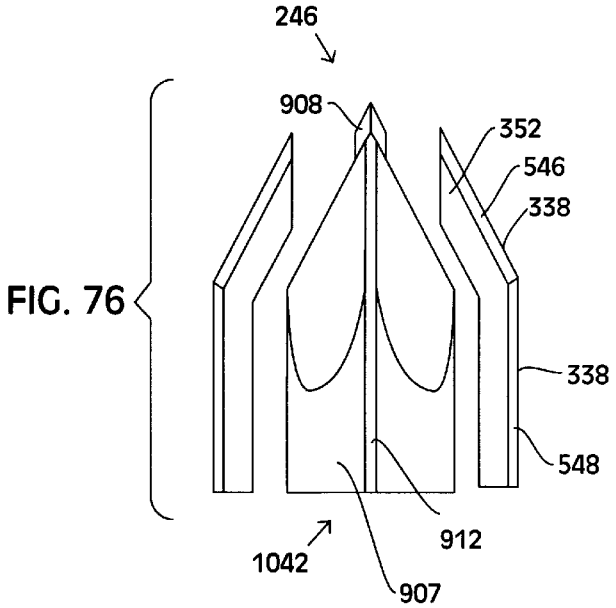
FIG. 76 is an exploded side view of the cutting tip as according to the preferred embodiment of this invention as illustrated in FIG. 73 showing the cutting tip with the tip blades removed.

FIGS. 73–76 illustrate a cutting tip 246. Cutting tip 246 is similar to cutting tip 244 as illustrated in FIGS. 69–72 except for the three cutting edges 338-338-338 of cutting tip 246 are the razor edges of attachable tip blades 352-352-352, which each fit into a corresponding slot 912 of a metal tip body 1042 as is illustrated in FIG. 76. Tip blades 352-352-352 each have a pair of bevels 546–546 that are situated between adjacent facets and form bevel boundaries 636*a*—636*a* thereat. Each tip blade 352 also has a pair of bevels 548–548 that run along barrel section 907 and form bevel boundaries 636*b*—636*b* thereat.

FIGS. 77–81 illustrate cutting tips 248, 250, 252 & 254 which all in common have bevels on both sides of their facet junctures such that the bevels do not extend completely to the forward leading apex of their respective cutting tips. Cutting tip 248 as illustrated in FIGS. 77 & 78 has three facets 434-434-434, a pair of bevels 550—550 that forms each cutting edge 340 and a three sided apex 917. It is apparent that each side of apex 917 could be hollow ground and therefore substantially concave. Each facet has a curved section 552 between bevels 550—550 thereon. It is apparent that the facets of cutting tip 248 could be cut or formed at least in part from a rotational machining tool whose axis of rotation changes in spatial orientation relative to the X-Y-Z axises of cutting tip 248 while forming a complete cut or at least a portion thereof. Cutting tip 248 has a barrel section 914 that is necked down as illustrated in FIG. 77. Cutting tip 250 as illustrated in FIG. 79 has four facets each with a cutting edge 342 that extends from between facet junctures rewards upon barrel section 914 thereof Cutting tip 252 as illustrated in FIG. 80 is similar to cutting tip 250 except the four cutting edges 344-344-344-344 of cutting tip 252 are found only along the junctures between the respective facets. Cutting tip 254 as illustrated in FIG. 81 has a substantially blunt apex 916, and four flat planar facets each with a cutting edge 346 that is found only along the junctures between the respective facets.

It is apparent that the cutting tips of this invention may have cutting edges as according to this invention along any axial length of their structure, whether integrally formed with, integrally attached or removably attachable to their respective cutting tips. It is also apparent that the cutting edges of a cutting tip as according to this invention may be aligned or oriented with respect to the central longitudinal axis thereof, the three dimensions as depicted in this specification by a Cartesian X-Y-Z axis system wherein the Y-axis is collinear with the central longitudinal axis thereof, and the facet junctures of their respective cutting tip in a variety of different manners. Such different aligned or oriented manners of the cutting edges include being inclined relative to one or more of the X, Y or Z axises and not being coplanar with a corresponding facet juncture. It is also apparent that cutting edges as according to this invention that are situated upon the barrel sections or equivalents of their respective cutting tips may be aligned or oriented with respect to the facet junctures of their cutting tips in a variety of manners, including not being in-line or coplanar with them.

FIGS. 82–84 illustrate a cutting tip 256. Cutting tip 256 has attachable tip blades 354-354-354 each having a cutting edge 348 and a pair of bevels 554—554. Each tip blade 354 fits into a slot 920 in the barrel section 918 of tip body 1044 where a pair of bevel boundaries 640—640 contact each tip blade 354. Tip body 1044 is preferably of a metal construction and tip blades 354-354-354 are preferably non-removably attached to tip body 1044 by welding, such as capillary welding or other welding techniques, but not limited thereto.

FIG. 85 illustrates a blade-opening arrowhead 758 with cutting tip 256 attached at the leading penetrating end.

FIGS. 86 & 87 illustrate a cutting tip 258 similar to cutting tip 256, but which is integrally attached with an arrowhead body 734 of a blade-opening arrowhead 760.

FIG. 88 illustrates a cross-section of a cutting tip 259 which is similar to cutting tip 258 of blade-opening arrowhead 734, except the tip blades are integrally fabricated with cutting tip 259.

Securement means as according to this invention has the intended meaning that a removably attachable tip blade or equivalent is retained in a cutting position when assembled with or to a corresponding tip body such that a plane perpendicular to the central longitudinal axis of the cutting tip intersects both a holding element, and a portion of the tip blade that is situated closer to the central longitudinal axis of the cutting tip than the holding element. Holding elements as according to this invention comprise portions of tip bodies, arrowhead bodies or mandrels, arrowhead blades, or other suitable structure or structures of the penetrating device utilizing such a cutting tip as according to this invention, or any combination of such structures that serve to limit undesired displacement or movement of tip blades. In this manner the tip blades will engage against the holding element or elements and therefore resist displacement in a radial direction as well as in axial directions from the tip body, thus securing the tip blades to their respective cutting tips.

Figure 89:
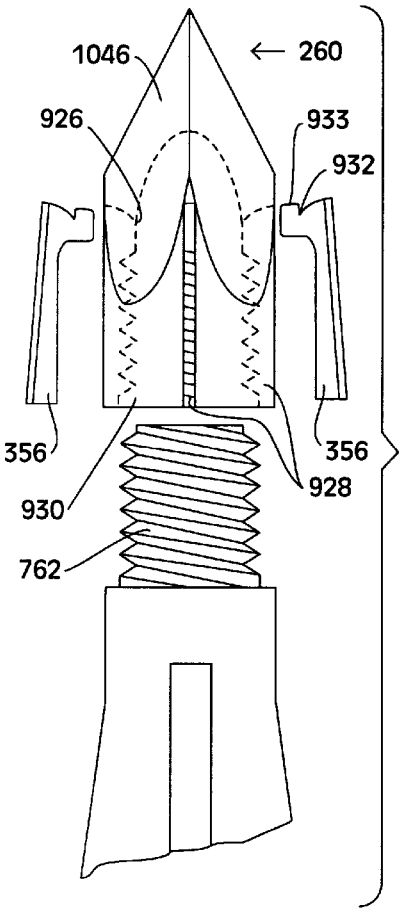
FIG. 89 is an exploded side view of an arrowhead body and cutting tip as according to this invention.
Figure 90:
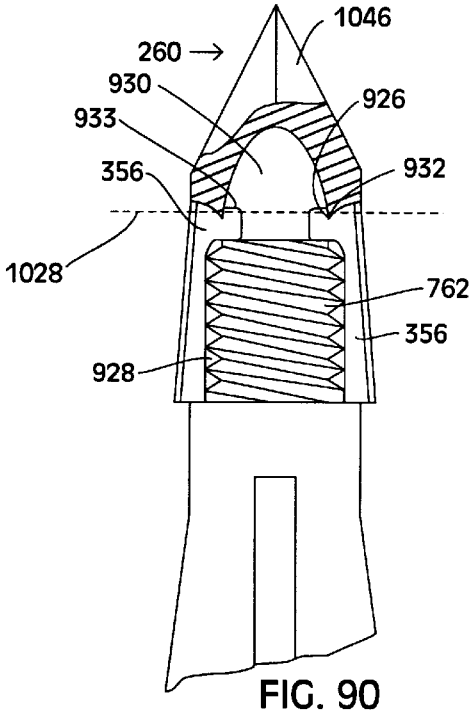
FIG. 90 is a partially sectioned side view of the assembled arrowhead components as illustrated in FIG. 89.

FIGS. 89 & 90 illustrate an example of securement means as according to this invention where a cutting tip 260 is shown to be removably attachable to a blade-opening arrowhead body. Cutting tip 260 has three facets, three slots 928-928-928 each with a catch-lip 926, three removably attachable tip blades 356-356-356 (only two tip blades 356—356 are shown for reasons of simplicity and illustration), and a tip body 1046 having an internally threaded female cavity 930 that threads onto a threaded male stud 762 of the arrowhead body. Each tip blade 356 has a notch 932 and a protrusion 933. Therefore, when tip blades 356-356-356 are inserted into slots 928-928-928 and tip body 1046 is threaded onto stud 762 each notch 932 mates with each corresponding catch-lip 926 such that each protrusion 933 is positioned forward of the rearward terminus of its corresponding catch-lip 926 thereby securing each tip blade 356 to tip body 1046 as according to the securement means of this invention. As is clearly illustrated in FIG. 90 a plane 1028 which is perpendicular to the central longitudinal axis of cutting tip 260 intersects protrusion 933 of each tip blade at a location closer to the central longitudinal axis of cutting tip 260 than the locations plane 1028 intersects each corresponding catch-lip 926 of tip body 1046, as is according to the securement means of this invention. Catch-lips 926-926-926 are examples of holding elements as according to the securement means of this invention.

Figure 91:
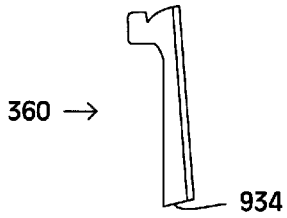
FIG. 91 is a side view of another tip blade as according to a preferred embodiment to this invention.

FIG. 91 illustrates a tip blade 360 which is similar to tip blade 356 except tip blade 360 has a sloped rear edge 934 which will minimize any possible barbing effect that could occur when a corresponding cutting tip is retracted from the substance it had penetrated.

Figure 92:
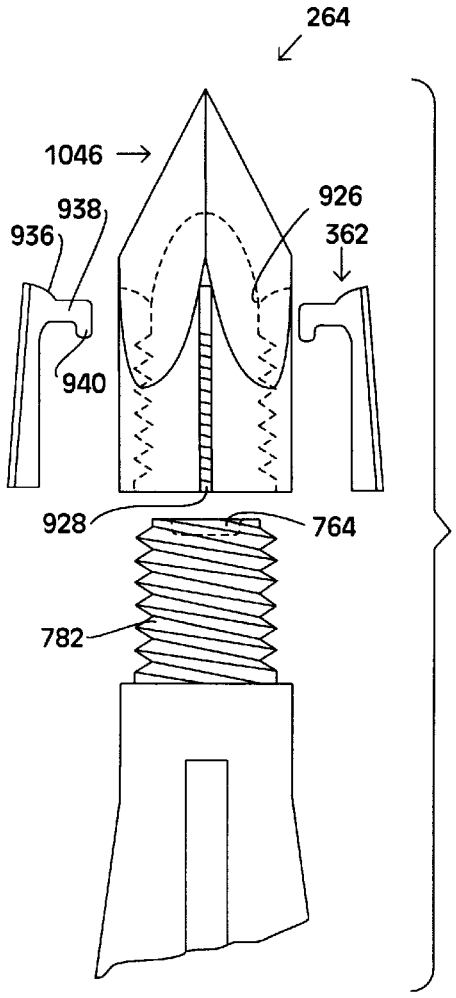
FIG. 92 is an exploded side view of an arrowhead body and cutting tip as according to this invention.
Figure 93:
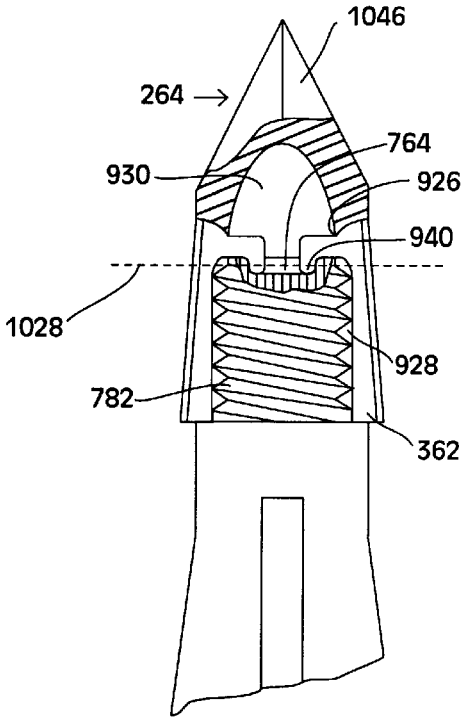
FIG. 93 is a partially sectioned side view of the assembled arrowhead components as illustrated in FIG. 92.

FIGS. 92 & 93 illustrate another example of securement means as according to this invention where a cutting tip 264 is shown to be removably attachable to a blade-opening arrowhead body. Cutting tip 264 has three facets, three slots 928-928-928 each with a catch-lip 926, three removably attachable tip blades 362-362-362, and a tip body 1046 having an internally threaded female cavity 930 that threads onto a threaded male stud 782 of the arrowhead body. Stud 782 has a depression 764 centrally axially formed at its forward end, as is illustrated in FIG. 92. Each tip blade 362 has a prong 940 and an arm 938. Prongs 940-940-940 are similar to protrusion 933-933-933 except that each prong 940 extends in a rearward direction when tip blades 362-362-362 are secured to cutting tip 264, whereas each protrusion 933 extends in a forward direction when tip blades 356-356-356 are secured to cutting tip 260. Therefore, when tip blades 362-362-362 are inserted into slots 928-928-928 and tip body 1046 is threaded onto stud 782 each prong 940 mates within depression 764 such that each prong 940 is positioned rearward of the forward terminus of stud 782 thereby securing each tip blade 362 to tip body 1046 as according to the securement means of this invention. As is clearly illustrated in FIG. 93 plane 1028 which is perpendicular to the central longitudinal axis of cutting tip 264 intersects each prong 940 of each tip blade at a location closer to the central longitudinal axis of cutting tip 264 than the locations plane 1028 intersects stud 782 of tip body 1046, as is according to the securement means of this invention. It is apparent that tip blades 362-362-362 could also each have a protrusion 933 and a notch 932 so as to mate with catch-lips 926 to further aid in the securement of tip blades to tip body 1046, as according to the desired results of this invention.

Figure 96:
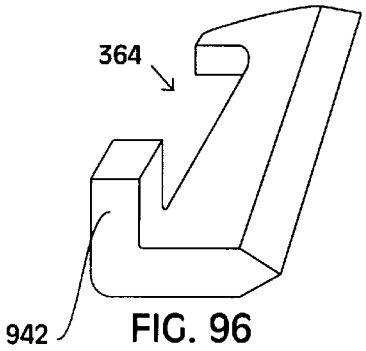
FIG. 96 is a perspective view of the tip blade as illustrated in FIGS. 94 & 95.
Figure 95:
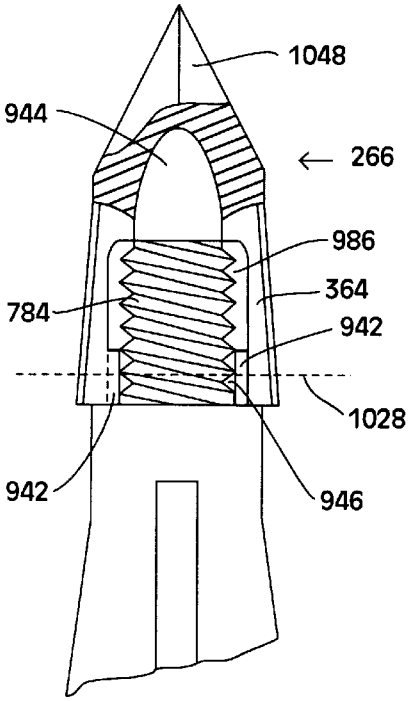
FIG. 95 is a partially sectioned side view of the assembled arrowhead components as illustrated in FIG. 94.
Figure 94:
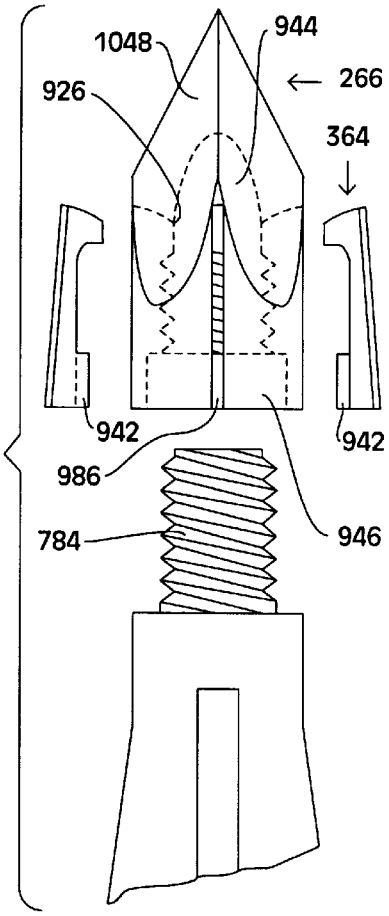
FIG. 94 is a side view of an arrowhead body and cutting tip as according to this invention.

FIGS. 94–96 illustrate another example of securement means as according to this invention where a cutting tip 266 is shown to be removably attachable to a blade-opening arrowhead body. Cutting tip 266 has three facets, three slots 986-986-986 each with a catch-lip 926, three removably attachable tip blades 364-364-364, and a tip body 1048 having an internally threaded female cavity 944 that threads onto a threaded male stud 784 of the arrowhead body. Internal cavity 944 has a larger diameter flange cavity 946 situated rearward of the threaded internal section as is illustrated in FIG. 94. Each tip blade 364 has a flange 942 as is illustrated in FIG. 96. Each flange 942 is substantially not coplanar with at least another section of its corresponding tip blade 364 as is clearly illustrated in FIG. 96. Therefore, when tip blades 364-364-364 are inserted into slots 986-986-986 and tip body 1048 is threaded onto stud 784 each flange 942 mates within flange cavity 946 such that each flange 942 is positioned circumferentially or laterally away from the opening of its corresponding slot 986 and against the inside wall of flange cavity 946 thereby securing each tip blade 364 to tip body 1048 as according to the securement means of this invention. As is clearly illustrated in FIG. 95 a plane 1028 which is perpendicular to the central longitudinal axis of cutting tip 266 intersects each flange 942 of each tip blade at a location closer to the central longitudinal axis of cutting tip 266 than the locations plane 1028 intersects tip body 1048, as is according to the securement means of this invention.

Figure 97A:
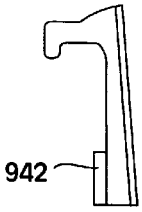
FIGS. 97*a–c* show other tip blades as according to other preferred embodiments of this invention.
Figure 97B:
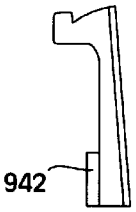
Figure 97C:
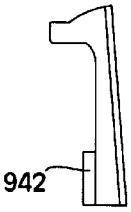

As is illustrated in FIGS. 97*a–c* it is apparent that tip blades having flanges 942 in combination with other tip blade structures as disclosed herein will further aid in the securement of the tips blades to corresponding tip bodies, as according to the securement means of this invention.

Figure 98:
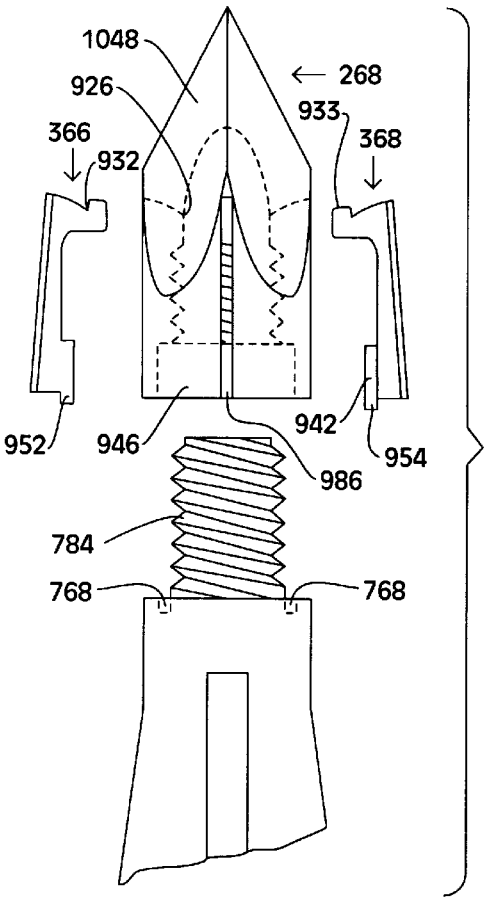
FIG. 98 is a side view of an arrowhead body and cutting tip as according to this invention.
Figure 99:
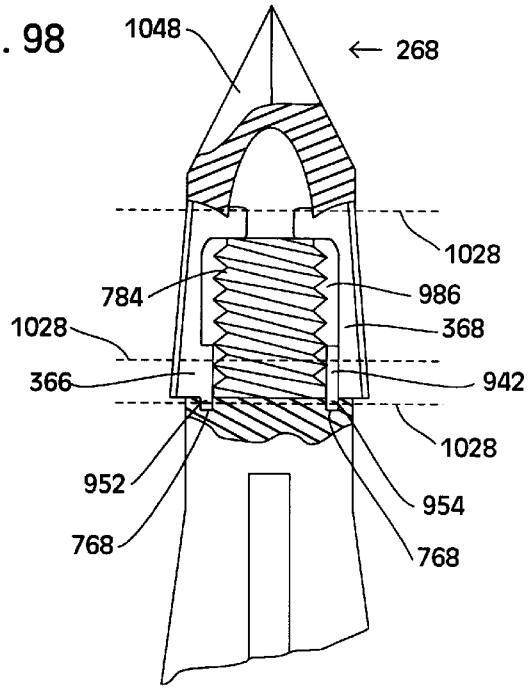
FIG. 99 is a partially sectioned side view of the assembled arrowhead components as illustrated in FIG. 98.

FIGS. 98 & 99 illustrate another example of securement means as according to this invention where a cutting tip 268 is shown to be removably attachable to a blade-opening arrowhead body. Cutting tip 268 has three facets, three slots 986-986-986 each with a catch-lip 926, three removably attachable tip blades (of which one is a tip blade 366 and another is a tip blade 368) as is illustrated in FIG. 98, and a tip body 1048 having an internally threaded female cavity that threads onto stud 784 of the arrowhead body. For reasons of simplicity FIGS. 98 & 99 show only two tip blades 366 and 368, but it is apparent that cutting tip 268 utilizes three tip blades. The arrowhead body has an annular recess 768 situated about stud 784. Tip blade 366 has a leg 952 and tip blade 368 has a leg 954. Leg 954 of tip blade 368 is an extension of flange 942. Therefore, when both blades 366 & 368 are inserted into their slots 986—986 and tip body 1048 is threaded onto stud 784 leg 954 of tip blade 368 and leg 952 of tip blade 366 mate within annular recess 768 such that each leg is positioned rearward of the forward terminus of annular recess 768 thereby securing each tip blade 366 & 368 to tip body 1048 as according to the securement means of this invention. As is clearly illustrated in FIG. 99 plane 1028 which is perpendicular to the central longitudinal axis of cutting tip 268 intersects leg 954 of tip blade 368 and leg 952 of tip blade 366 at locations closer to the central longitudinal axis of cutting tip 268 than the locations plane 1028 intersects the arrowhead body, as is according to the securement means of this invention. As is obvious from FIG. 99 tip blades 366 & 368 may also incorporate other structural tip blade variations of the securement means according to this invention as have been disclosed herein, in combination with legs 952 & 954 or their equivalents which mate in annular recesses like annular recess 768.

FIGS. 100 & 101 illustrate yet another example of securement means as according to this invention where a cutting tip 270 is shown to be removably attachable to a blade-opening arrowhead body. Cutting tip 270 has three facets, three slots 960-960-960, three removably attachable tip blades 370-370-370, and a tip body 1050. Tip body 1050 has an undercut cavity 958, a sloped undercut wall 970, an externally threaded male stud 962 that threads into a threaded female cavity 968 of the arrowhead body. Sloped undercut wall 970 abuts against an annular shelf 966 of the arrowhead body when tip body 1050 is attached thereto. The arrowhead body has a larger diameter leg cavity 984 situated forward of threaded internal cavity 968 as is illustrated in FIG. 100. Each tip blade 370 has an abutment edge 972 which abuts against annular shelf 966 of the arrowhead body as is illustrated in FIG. 101. Each tip blade 370 has a leg 956 so that when tip blades 370-370-370 are inserted into slots 960-960-960 and tip body 1050 is threaded into cavity 968 each leg 956 mates within leg cavity 984 such that at least a portion of each leg 956 is positioned rearward of the forward terminus of the arrowhead body and against the inside wall of leg cavity 984 thereby securing each tip blade 370 to tip body 1050 as according to the securement means of this invention. As is clearly illustrated in FIG. 101 plane 1028 which is perpendicular to the central longitudinal axis of cutting tip 270 intersects each leg 956 of each tip blade 370 at a location closer to the central longitudinal axis of cutting tip 270 than the locations plane 1028 intersects the arrowhead body, as according to the securement means of this invention.

FIG. 102 illustrates a tip blade 372 having a notch 927 and a protrusion 935. Tip blade 372 shows that catch-lip, notch and protrusion type securing features can be combined with legs 956 or their equivalents of the tip blades of this invention similar to a tip blade 370 so as to enhance the securement of the tip blades to their tip bodies.

Figures 103, 104, 105, 106, 107:
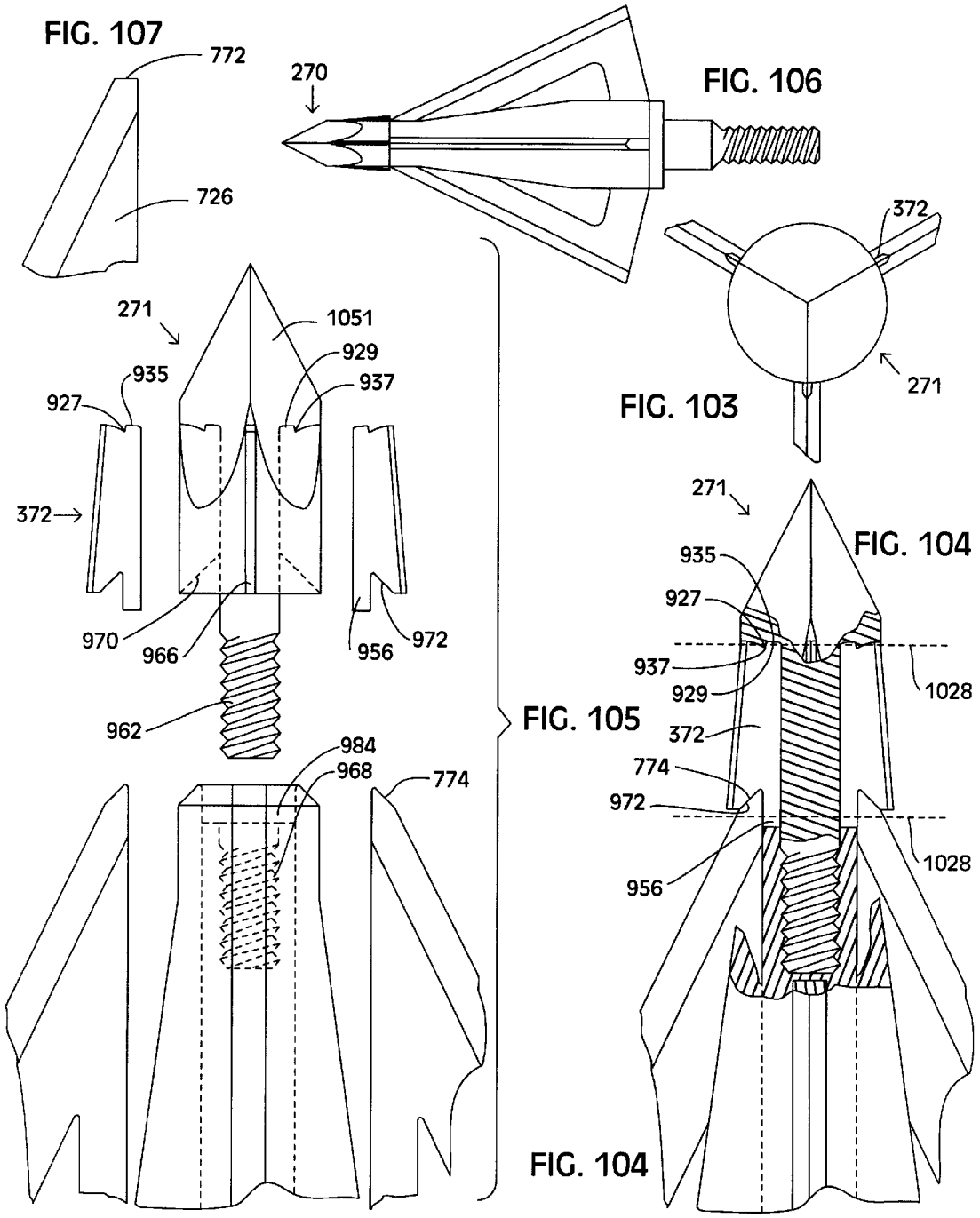
FIG. 103 is a side view of a fixed-blade arrowhead with a cutting tip as according to a preferred embodiment of this invention.
FIG. 104 is a top view of the fixed-blade arrowhead as illustrated in FIG. 103.
FIG. 105 is an exploded side view of the arrowhead body and cutting tip of the arrowhead as illustrated in FIG. 103.
FIG. 106 is a partially sectioned side view of the assembled arrowhead components as illustrated in FIG. 105.
FIG. 107 is a side view of another fixed-blade arrowhead blade according to another preferred embodiment of this invention.

FIGS. 103–106 illustrate how an example of securement means similar to the securement means embodiment as illustrated in FIGS. 100–101 as according to this invention is applicable to a fixed-blade arrowhead. FIG. 105 shows that a cutting tip 271 is removably attachable to a fixed-blade arrowhead body. Each forward edge section 774 of the fixed cutting blades of the arrowhead abut against corresponding abutment edges 972-972-972 of tip blades 372-372-372 when the arrowhead is assembled as is illustrated in FIG. 104. Tip body 1051 differs from tip body 1050 of cutting tip 270 as illustrated in FIGS. 100 & 101 in that tip body 1051 has a void 929 and a catch-lip 937 in each slot 966 thereof Each tip blade 372 has a protrusion 935 and a notch 927. Therefore, when tip blades 372-372-372 are inserted into slots 966-966-966 and tip body 1051 is threaded into the arrowhead body, each notch 927 mates with each corresponding catch-lip 937 such that each protrusion 935 is positioned forward of the rearward terminus of its corresponding catch-lip 937 thereby securing each tip blade 372 to tip body 1051 as according to the securement means of this invention. As is clearly illustrated in FIG. 104 plane 1028 which is perpendicular to the central longitudinal axis of cutting tip 271 intersects protrusion 935 of each tip blade at a location closer to the central longitudinal axis of cutting tip 271 than the locations plane 1028 intersects each corresponding catch-lip 937 of tip body 1051, as is according to the securement means of this invention.

It is apparent that the securement means as according to this invention may be used to secure tip blades or their equivalents between facet junctures of cutting tips as according to this invention.

FIG. 107 illustrates a forward end 772 of a fixed-blade arrowhead blade 726. It is apparent that the forward end of the fixed-blade arrowhead blades used in conjunction with cutting tips of this invention having tip blades, may have different shapes such as being substantially flat, so as to optimally fit with their corresponding cutting tip.

Figures 108, 109, 110, 111, 112, 113:
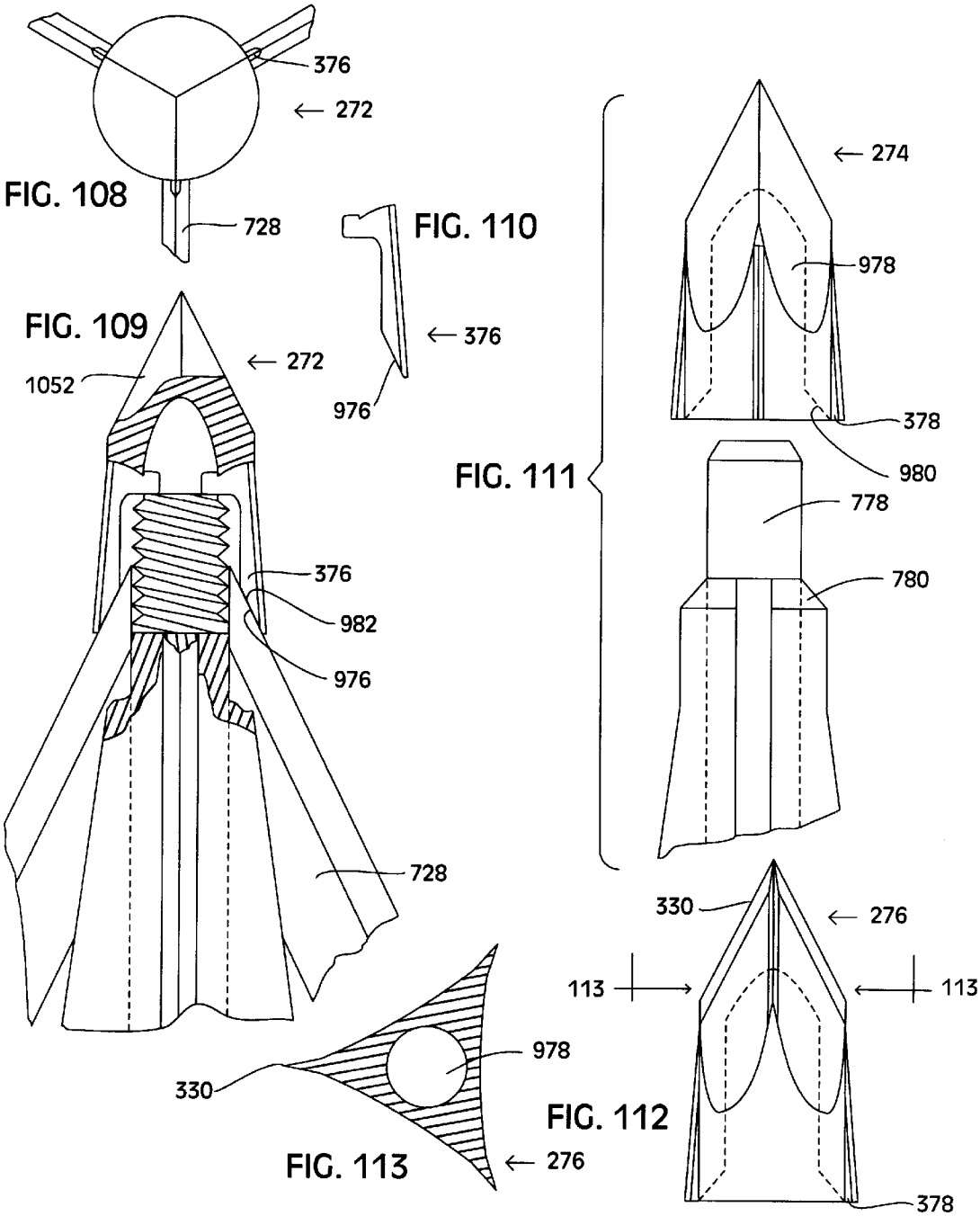
FIG. 108 is a top view of another fixed-blade arrowhead having a cutting tip as according to another preferred embodiment of this invention.
FIG. 109 is a partially sectioned side view of the arrowhead body and cutting tip as according to the preferred embodiment of this invention as illustrated in FIG. 108.
FIG. 110 is a side view of a tip blade of the cutting tip of the fixed-blade arrowhead of this invention as illustrated in FIGS. 108 & 109.
FIG. 111 is an exploded side view of another cutting tip as according to this invention.
FIG. 112 is a side view of another cutting tip as according to this invention.
FIG. 113 is a cross-sectional view of the cutting tip as illustrated in FIG. 112 taken along line 113—113.
Figure 118:
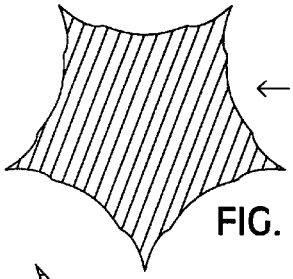
FIGS. 118–131 are cross-sectional views of yet other cutting tips as according to this invention.
Figure 119:
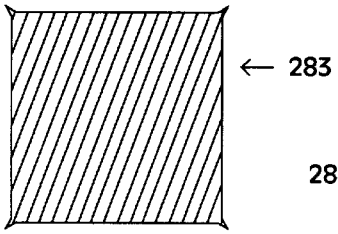
Figure 120:
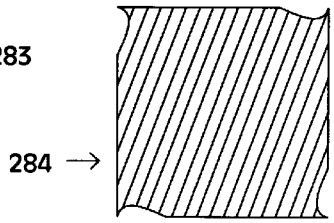
Figure 121:
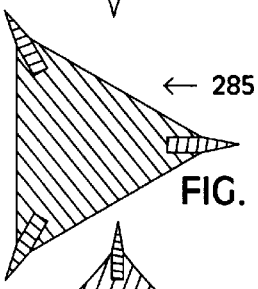
Figure 122:
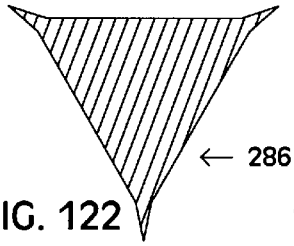
Figure 123:
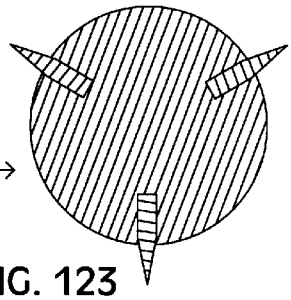
Figure 124:
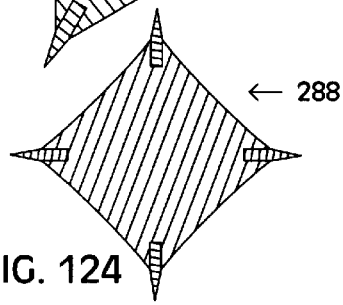
Figure 125:
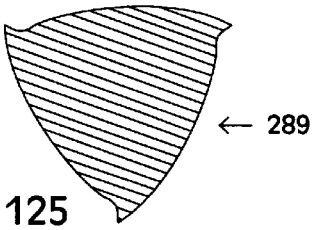
Figure 126:
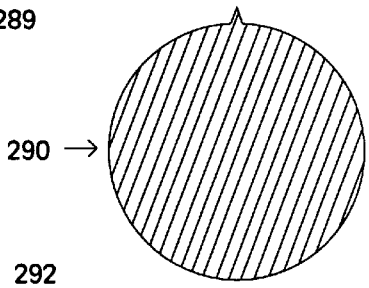
Figure 127:
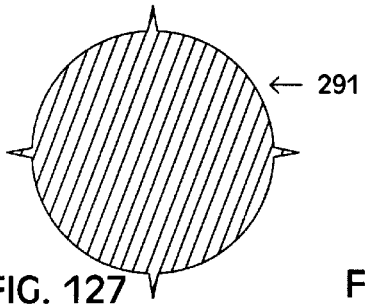
Figure 128:
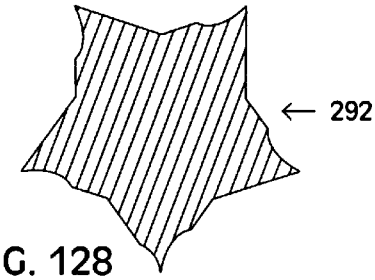
Figure 131:
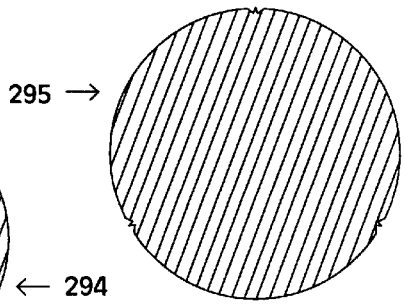
Figure 129:
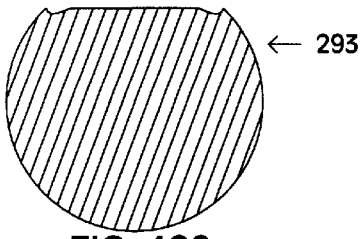
Figure 130:
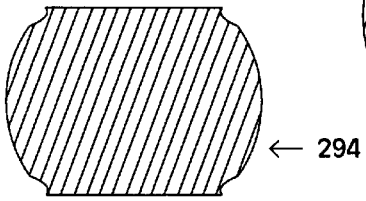

FIGS. 108 & 109 illustrate a cutting tip 272 of a fixed-blade arrowhead, which has fixed-blade arrowhead cutting blades 728-728-728. Each cutting blade 728 has a substantially straight cutting edge 982 at its forward end that abuts against an abutment edge 976 of a tip blade 376 which is secured to a female screw on type tip body 1052 as according to the securement means of this invention. Cutting tip 272 as illustrated in FIG. 109 provides razor sharp tip blades or cutting blades on a chisel type cutting tip while also allowing to lock the upper section 982 of a fixed cutting blade 728 to an arrowhead body by tucking the forward end of the arrowhead blade in an undercut cavity of the chisel type tip—as is a very common practice in the archery industry.

FIG. 111 shows a press-on fit tip 274 which has tip blades 378-378-378, an undercut wall 980 that abuts against an annular shelf 780 of the arrowhead body, and an internal female cavity 978 which fits around a male stud 778 of the arrowhead body when tip 274 is pressed thereon.

It is apparent that there are many methods of attaching the cutting tips as according to this invention to their respective penetrating devices, including forming them integrally thereon.

FIGS. 112 & 113 illustrated a press-on fit cutting tip 276. Cutting tip 276 is similar to cutting tip 274 as illustrated in FIG. 111 except cutting tip 276 has cutting edges 330-330-330 and accompanying bevels as according to this invention located at the facet junctures in addition to having tip blades 378-378-378 on the barrel section thereof.

It is apparent that the cutting tips as according to this invention may have both true cutting edges or razor sharp cutting edges as according to this invention at their facet junctures or equivalents as well as on their barrel sections or equivalents, which may comprise tip blades as have been disclosed herein. It is apparent that any of the different facet juncture cutting edge designs as illustrated or suggested herein may be combined with any of the tip blade designs, including in manners that have not been suggested herein.

It is apparent that different cutting tips as according to the desired results of this invention exist which have not been discussed above. It is apparent that the different parts and structural shapes and their equivalents as according to the cutting tips of this invention, as discussed above and as according to other preferred embodiments of this invention, can be changed, or interchanged, or eliminated, or duplicated, or made of different materials, and connected to or associated with adjacent elements in different manners, other than suggested herein, without deterring from the desired results of the cutting tips as according to this invention.

For example FIGS. 114 & 115 show a cutting tip 278 that has both integral cutting edges 316-316-316 each formed by a pair of bevels 516-516 at facet junctures, in conjunction with cutting edges 376-376-376 of tip blades 378-378-378 on the barrel section thereof.

Also FIGS. 116 & 117 illustrate a cutting tip 280 that has both integral cutting edges 300-300-300 each formed by a corresponding bevel 500 at facet junctures, and cutting edges 376-376-376 of tip blades 378-378-378 on the barrel section thereof. It is apparent that cutting edges 376-376-376 could be integrally formed with the barrel section of cutting tip 280 or that they could be attachable whether removably so or not. It is apparent that each cutting edge 376 may be an integrally ground part of the barrel section of cutting tip 280.

FIGS. 118–131 illustrate cross-sectional views of cutting tips 282–294 as according to this invention. Cutting tips 282–294 illustrate other possible structural arrangements of facet sections and/or barrel sections that may be associated with or be part of the cutting tips as according to this invention. It is apparent that cutting edges of cutting tips 282–294 could be integrally formed or ground thereon or that they could be attachable whether removably so or not, despite how they are specifically illustrated in FIGS. 118–131.

It is apparent that the number of cutting edges per individual cutting tip i.e. attachable tip blades and/or integrally formed cutting edges such as formed at facet junctures by one or more bevels, may vary. The number of cutting edges is preferably between 1 and 7 but may include more depending on the tip design and intended use of the penetrating or cutting device. Although the preferred embodiments of this invention have predominantly illustrated a ratio of one cutting edge for each facet of a corresponding cutting tip, it is apparent that cutting tips having more than one cutting edge per facet is within the scope of this invention, especially in cutting edge arrangements other than have been disclosed herein.

It is to be understood that the present invention is not limited to the sole embodiments described above, as will become apparent to those skilled in the art, but encompasses the essence of all embodiments, and their legal equivalents, within the scope of the following claims.

I claim:

1. An arrowhead comprising:

(a) an arrowhead body; and (b) an arrowhead tip, said arrowhead tip comprising:

(i) a first facet boundary;

(ii) a second facet boundary; and (iii) a facet extending therebetween, wherein at least a section of said facet is convex.

2. An arrowhead as recited in claim 1 wherein said arrowhead tip is removably attachable with said arrowhead body.

3. An arrowhead as recited in claim 1 wherein said arrowhead tip is substantially non-removably attachable with said arrowhead body.

4. An arrowhead as recited in claim 1 wherein said arrowhead tip is integrally fabricated with said arrowhead body.

5. An arrowhead as recited in claim 1 wherein said facet boundaries converge to a forwardly tapered apex point, said apex point being collinear with a central longitudinal axis of said arrowhead body.

6. An arrowhead as recited in claim 5 wherein a substantial majority of each said facet boundary is radially aligned with said central longitudinal axis of said arrowhead body.

7. An arrowhead as recited in claim 1 wherein at least a section of each said facet boundary comprises a cutting edge.

8. An arrowhead as recited in claim 1 further comprising a plurality of said facets.

9. An arrowhead as recited in claim 8 wherein each said facet is substantially entirely convex.

10. An arrowhead as recited in claim 9 wherein said plurality of facets comprises three said facets.

11. An arrowhead as recited in claim 10 wherein said arrowhead tip is attached to said arrowhead body.

12. An arrowhead as recited in claim 9 further comprising a pivotal blade hingedly attached to said arrowhead body.

13. An arrowhead as recited in claim 8 wherein each said facet is convex.

14. An arrowhead as recited in claim 13 wherein said plurality of facets comprises three said facets.

15. An arrowhead as recited in claim 1 wherein said arrowhead is a blade-opening arrowhead.

16. An arrowhead as recited in claim 1 wherein said arrowhead is a fixed-blade arrowhead.

17. An arrowhead comprising:

(a) an arrowhead body; and (b) an arrowhead tip having a central longitudinal axis, said arrowhead tip comprising:

(i) a first facet boundary;

(ii) a second facet boundary;

(iii) a facet extending therebetween, said facet having an exterior surface;

(iv) an intersecting line disposed in a plane perpendicular to said longitudinal axis and extending between said first facet boundary and said second facet boundary; and (v) a radial line disposed in said plane so as to extend outwardly from said central longitudinal axis, wherein the distance along said radial line from said central longitudinal axis to at least a section of said exterior surface of said facet is longer than the distance along said radial line from said central longitudinal axis to said intersecting line.

18. An arrowhead as recited in claim 17 wherein at least a section of said exterior surface of said facet is substantially convex.

19. An arrowhead as recited in claim 17 wherein at least a section of each said facet boundary comprises a cutting edge.

20. An arrowhead as recited in claim 17 further comprising a plurality of said facets.

21. An arrowhead as recited in claim 20 wherein a substantial majority of the exterior surface of each said facet lying in said plane is convex and situated upon said arrowhead tip so that a circle disposed in said plane and intersecting each said facet boundary concomitantly intersects a substantial majority of each said convex facet exterior surface.

22. An arrowhead as recited in claim 20 wherein at least one of said facets, as referenced in said plane perpendicular to said central longitudinal axis, has at least a section of an exterior surface thereof that is substantially convex so as to define at least a section of the perimeter of a fist circle, wherein the diameter of said first circle is of a different diameter than the diameter of a second circle, said second circle also being disposed in said plane perpendicular to said longitudinal axis and intersecting each said first and second facet boundaries of each said facet of said plurality of facets.

23. An arrowhead as recited in claim 22 wherein the diameter of said first circle is a larger diameter than the diameter of said second circle.

24. An arrowhead as recited in claim 22 wherein said facet boundaries converge to a forwardly tapered apex point, said apex point being collinear with a central longitudinal axis of said arrowhead body.

25. An arrowhead as recited in claim 20 wherein each said facet is convex.

26. An arrowhead as recited in claim 25 wherein said plurality of facets comprises at least three said facets.

27. An arrowhead as recited in claim 17 further comprising a pivotal cutting blade hingedly attached to said arrowhead body.

28. An arrowhead as recited in claim 17 wherein said arrowhead is a fixed-blade arrowhead.

29. An arrowhead comprising:

(a) an arrowhead body, and (b) an arrowhead tip, said arrowhead tip comprising:

(i) a central longitudinal axis; and (ii) a plurality of facets each extending between a first facet boundary and a second facet boundary wherein at least one of said facets, as referenced in a plane perpendicular to said central longitudinal axis, has at least a section of an exterior surface thereof that is substantially convex so as to define at least a section of the perimeter of a first circle, wherein the radius of said first circle is larger than the radius of a second circle, said second circle also being disposed in said plane perpendicular to said longitudinal axis and intersecting each said first and second facet boundaries of each said facet of said plurality of facets.

30. An arrowhead as recited in claim 29 wherein said facet boundaries converge to a forwardly tapered apex point, said apex point being collinear with a central longitudinal axis of said arrowhead body.

31. An arrowhead as recited in claim 29 wherein at least a section of each said facet boundary comprises a cutting edge.

32. An arrowhead as recited in claim 29 further comprising a pivotal cutting blade hingedly attached to said arrowhead body.

33. An arrowhead as recited in claim 29 wherein said arrowhead is a blade-opening arrowhead.

34. An arrowhead as recited in claim 29 wherein said arrowhead is a fixed-blade arrowhead.

35. An arrowhead as recited in claim 29 wherein said plurality of facets comprises three said facets.

36. An arrowhead as recited in claim 35 wherein each said facet is configured substantially identical to each other said facet of said plurality of facets.

37. An arrowhead as recited in claim 29 wherein each said facet is convex.

38. An arrowhead comprising:

(a) an arrowhead body; and (b) an arrowhead tip having a central longitudinal axis, said arrowhead tip comprising:

(i) a first facet boundary;

(ii) a second facet boundary; and (iii) a facet extending therebetween, said facet having an exterior surface and being configured such that the distance along a radial line, disposed in a plane perpendicular to said longitudinal axis, that extends from said central longitudinal axis to at least a section of said exterior surface of said facet is longer than the distance along said radial line to an intersecting line also disposed in said plane perpendicular to said longitudinal axis, said intersecting line extending between said first facet boundary and said second facet boundary.

39. An arrowhead as recited in claim 38 further comprising a plurality of said facets.

40. An arrowhead as recited in claim 39 wherein at least a section of each said facet is convex.

41. An arrowhead as recited in claim 39 wherein a substantial majority of each said facet is convex.

42. An arrowhead as recited in claim 41 wherein said plurality of facets comprises three said facets.

43. An arrowhead as recited in claim 41 further comprising a pivotal blade hingedly attached to said arrowhead body.

44. An arrowhead comprising:

(a) an arrowhead body; and (b) an arrowhead tip, said arrowhead tip comprising:

(i) a central longitudinal axis; and (ii) a plurality of substantially convex facets each having an exterior surface and each extending between a first facet boundary and a second facet boundary, said arrowhead tip being configured such that the distance along a first radial line, disposed in a plane perpendicular to said longitudinal axis, that extends from said central longitudinal axis to at least a section of said exterior surface of said facet is shorter than the distance along a second radial line, also disposed in said plane perpendicular to said longitudinal axis, that extends from said central longitudinal axis to a said facet boundary of said arrowhead tip.

45. An arrowhead as recited in claim 44 wherein each said facet is configured substantially identical to each other said facet of said plurality of facets.

46. An arrowhead as recited in claim 45 wherein at least a substantial majority of the exterior surface of a said facet, as referenced in said plane perpendicular to said longitudinal axis, defines at least a section of the perimeter of a circle.

47. An arrowhead comprising:

(a) an arrowhead body; and (b) an arrowhead tip, said arrowhead tip comprising:

(i) a central longitudinal axis;

(ii) an exterior surface; and (ii) a plurality of three substantially convex facets each extending between a first facet boundary and a second facet boundary, said arrowhead tip being configured such that the distance along a first radial line, disposed in a plane perpendicular to said longitudinal axis, that extends from said central longitudinal axis to at least a first section of said exterior surface of said arrowhead tip is different than the distance along a second radial line, also disposed in said plane perpendicular to said longitudinal axis, that extends from said central longitudinal axis to at least a second different section of said exterior surface of said arrowhead tip.

48. An arrowhead as recited in claim 47 wherein each said facet is configured substantially identical to each other said facet of said plurality of facets.

49. An arrowhead as recited in claim 48 wherein each said facet is convex.

50. An arrowhead comprising:

(a) an arrowhead body; and (b) an arrowhead tip having a plurality of convex facets that each extend between a corresponding first facet boundary and a corresponding second facet boundary thereof.

51. An arrowhead as recited in claim 50 further comprising a pivotal blade hingedly attached to said arrowhead body.

52. An arrowhead as recited in claim 51 wherein said arrowhead tip is attached to said arrowhead body.

53. An arrowhead as recited in claim 50 wherein each said facet is configured substantially identical to each other said facet of said plurality of facets.

54. An arrowhead as recited in claim 53 wherein said plurality of facets comprises three said facets.

55. An arrowhead as recited in claim 54 wherein each said facet comprises an exterior surface, and said arrowhead tip is configured such that the distance along a fist radial line, disposed in a plane perpendicular to said longitudinal axis, that extends from said central longitudinal axis to at least a section of said exterior surface of a said facet is shorter than the distance along a second radial line, also disposed in said plane perpendicular to said longitudinal axis, that extends from said central longitudinal axis to a said facet boundary of said arrowhead tip.

* * * * *